US010743634B2

(12) United States Patent
Murphy et al.

(10) Patent No.: US 10,743,634 B2
(45) Date of Patent: Aug. 18, 2020

(54) ENHANCED APPLICATION OF OIL-BASED PRODUCTS FROM FLUID CONTAINERS

(71) Applicant: RLM Group Ltd., Mt. Kisco, NY (US)

(72) Inventors: Robert L. Murphy, Somers, NY (US); Charles A. Curtiss, Norwalk, CT (US)

(73) Assignee: RLM Group Ltd., Mt. Kisco, NY (US)

( * ) Notice: Subject to any disclaimer, the term of this patent is extended or adjusted under 35 U.S.C. 154(b) by 867 days.

(21) Appl. No.: 15/120,606

(22) PCT Filed: Feb. 23, 2015

(86) PCT No.: PCT/US2015/017051

§ 371 (c)(1),
(2) Date: Dec. 1, 2016

(87) PCT Pub. No.: WO2015/127346

PCT Pub. Date: Aug. 27, 2015

(65) Prior Publication Data

US 2019/0208889 A1 Jul. 11, 2019

Related U.S. Application Data

(60) Provisional application No. 61/942,840, filed on Feb. 21, 2014.

(51) Int. Cl.

| | |
|---|---|
| ***B65D 35/36*** | (2006.01) |
| ***B65D 47/42*** | (2006.01) |
| ***A45D 34/04*** | (2006.01) |
| ***A45D 40/26*** | (2006.01) |

(52) U.S. Cl.

CPC ..... *A45D 34/04* (2013.01); *A45D 40/26* (2013.01); *B65D 35/36* (2013.01); *B65D 47/42* (2013.01); *A45D 2200/1009* (2013.01)

(58) Field of Classification Search

CPC ..... A45D 2200/1045; A45D 34/04; A45D 40/26; A45D 2200/1009; A45D 2200/1018; B65D 35/36; B65D 47/42; B05C 17/00; A61F 13/15; A61F 20/13; A61F 20/15008; A61F 13/15203

See application file for complete search history.

(56) References Cited

U.S. PATENT DOCUMENTS 3,010,138 A * 11/1961 Nadai ..... B65D 47/42 401/13
3,481,678 A * 12/1969 Schwartzman ..... B65D 47/42 401/206
4,336,767 A * 6/1982 Wada ..... B41F 31/24 101/333

(Continued)

OTHER PUBLICATIONS

The International Search Report of the International Searching Authority for International Application No. PCT/US15/17051, 4 pages.

*Primary Examiner* — David J Walczak
(74) *Attorney, Agent, or Firm* — Michael D. Lazzara; Leech Tishman Fuscaldo & Lampl

(57) ABSTRACT

Enhanced structures, devices, and techniques allow fluids and liquid products, such as cosmetics, to be applied in a cleaner and more effective manner. Various embodiments of fluid dispensing apparatuses are provided which employ fluid communication materials for promoting effective and repeatable fluid dispensing during use and resisting unwanted migration of fluids during non-use.

15 Claims, 17 Drawing Sheets

(56) References Cited

U.S. PATENT DOCUMENTS

| | | | | |
|---|---|---|---|---|
| 5,938,087 | A | 8/1999 | Randall | |
| 7,275,884 | B2 | 10/2007 | Sassouni | |
| 7,338,228 | B2 * | 3/2008 | Ducroquet | A45D 34/04 401/262 |
| 7,396,180 | B2 * | 7/2008 | Bugla | A45D 34/04 401/263 |
| 2006/0283896 | A1 * | 12/2006 | Kasting | B65D 47/24 222/549 |
| 2009/0200339 | A1 | 8/2009 | Quinlan et al. | |
| 2013/0292424 | A1 | 11/2013 | Laible | |

* cited by examiner

ENHANCED APPLICATION OF OIL-BASED PRODUCTS FROM FLUID CONTAINERS

FIELD OF THE INVENTION

In various embodiments, the present invention generally relates to tools, techniques, structures, devices, and processes for effectively and efficiently applying fluid from fluid containers. In particular embodiments of the invention, improved fluid containers and associated structures are provided for dispensing oil-based fluid products.

BACKGROUND

In the world of high quality consumer products, it is important to have product designs and packages that function effectively for their intended purposes. With respect to the cosmetics industry, for example, it is especially important to provide fluid containers that can meet consumer needs by providing efficient and clean application of fluids such as creams, oils, make-up, and other types of cosmetics.

However, many current package and container designs for fluid containers suffer from deficiencies in how they deliver and apply an appropriate dosage of fluid. An insufficient dosage of fluid does not provide enough product to meet the needs of the consumer. On the other hand, an excess dosage generates extra product that cannot be readily used by the consumer or which can interfere with the operative components of a fluid dispensing apparatus. This extra product creates a clean-up problem for the consumer who must decide how to dispose of the extra fluid that has been dispensed. Also, such extra product can cause undesirable clogging or mess for the handheld parts of a fluid container, for example.

In the case of oil based products used in the cosmetic industry, standard package options have traditionally involved using an expensive dropper in a bottle. However, such packages do not eliminate the migration of oil-based fluids, for example, to and around the outskirts of the package.

In view of the issues afflicting existing product designs and packages, including within the cosmetics industry, enhanced product dispensing and application technology is needed. Fluid dispensing structures, devices, and techniques are needed that can apply fluids in a predictable manner, without causing significant dripping or substantial clogging of the operative components of a fluid container.

BRIEF DESCRIPTION OF THE FIGURES

The utility of the embodiments of the invention will be readily appreciated and understood from consideration of the following description of the embodiments of the invention when viewed in connection with the accompanying drawings, wherein.

DESCRIPTION

Figure 2:
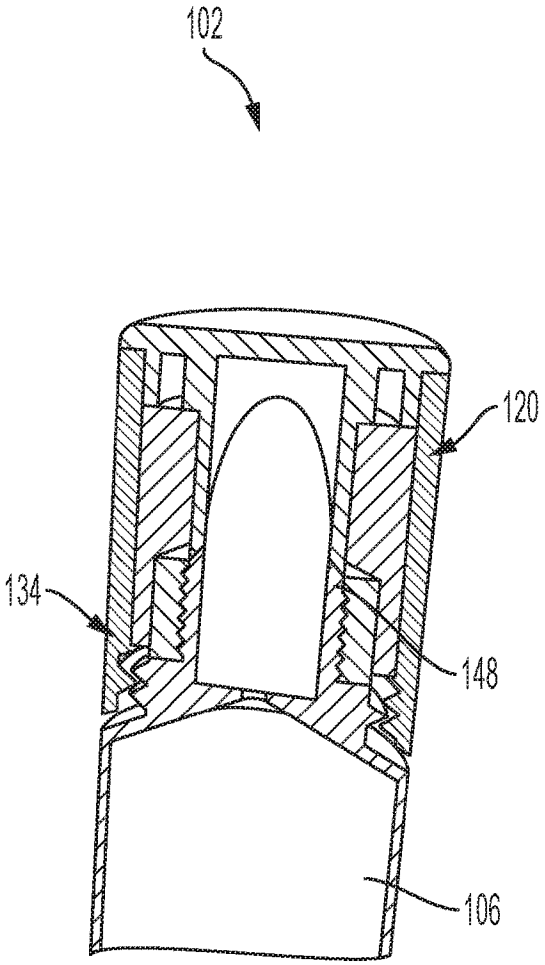
FIG. 2 includes another sectional view of the fluid dispensing apparatus of FIG. 1A.

In developing the various embodiments of the invention described herein, the inventors have created structures, devices, and techniques that allow fluid and liquid products, such as cosmetics, to apply fluids in a manner that resists waste and unwanted migration of fluid. The inventors appreciate that reasonable consumer expectations of predictable fluid dispensing should include reducing the migration of oil to the outside or hand holding parts of the package. Also, in connection with employing different embodiments of the invention, a consumer should be able to hold a tube or other type of fluid container in an inverted position without causing substantial dripping or oozing from its applicator. The inventors have recognized the need for an accurate correlation, and in certain cases independence, between a threshold pressure applied to a fluid container (such as manual pressure applied by a user, or pressure applied by some other device) and an appropriate amount of fluid dispensed from the container. It has been appreciated that minimizing accumulation of fluid at the dispensing site of the fluid container avoids the attendant clean-up that typically must be performed by a consumer.

In developing the invention described herein, the inventors have satisfied a long-felt and long overlooked need in the cosmetics industry, among other areas, to enhance inefficient and less than optimum fluid application technology in existing cosmetic containers. Use of certain embodiments of the invention can resist messy or wasteful use of product after initial dispensing of fluid onto a consumer's face or other body parts and can resist dispensing even if the fluid container is shaken or agitated. In certain aspects of the invention, a tube-type fluid container can be held in an inverted position without substantial excess fluid product being dispensed. Embodiments of the invention may be structured so that product can be applied by a fluid dispensing apparatus in a clean (i.e., non-splattering) and substantially regular manner.

It can be appreciated that consumer product companies are often concerned with excessive or messy dispensing of oil-based fluids because of liability claims which can arise from damage to clothing, furniture, or other articles as a result of excess product. Consumer product companies are also sensitive to reducing the costs of packaging and dispensing technology while maximizing marketing appeal to consumers. In developing the various embodiments of the invention, the inventors have provided structures, devices, and techniques which are functionally effective and which can be manufactured economically.

In various embodiments described herein, apparatus, devices, and tools are provided that can be configured for application to standard fluid containers, such as containers for cosmetic products. It can be appreciated that the embodiments of the invention may be modified or structured to accommodate different pore sizes of fluid communication materials, different fluid container materials, different fluid container shapes, and/or different types of fluids or fluid viscosities. For example, embodiments of the invention may be readily modified or structured to function with various fluid communication materials having an orifice dimension structured for controlling the migration of oil-based fluids, for example, in and around a fluid dispensing apparatus.

In developing the invention, the inventors have recognized the advantages of leveraging existing containers such as tubes made from plastic or similar materials which typically offer a safe and effective way to deliver product. Such tubes protect the product while providing a reasonably long shelf life. Also, there are many ways to decorate a tube in order to meet a prestige or premium consumer market.

The inventors are also aware that how a product is dispensed is an important consideration in the product packaging business. For example, consumer complaints may arise because product leaked into a purse or spilled onto a blouse, or simply because the fluid container delivered a dose that was either too little or too much. In addition, application of fluid from a fluid dispensing apparatus should not cause fluid to migrate or dispense onto other operative components of the apparatus. In any event, the product may not dispense correctly or cleanly from the fluid container, and consequently the container can be perceived as non-functional.

Also, by taking into account the demand for lower component costs, the inventors were motivated to improve on existing fluid delivery structures, techniques, and systems. It can be seen that use of certain embodiments of the invention can create opportunities for more products to be considered for the plastic tube, for example, versus other types of containers that require external, mechanical pumps, for example. The inventors have recognized the importance of identifying and designing multiple options and materials, because there are many products or fluids which require different application and dispensing strategies.

As applied to various embodiments described throughout the present description, a threshold fluid pressure may be defined as the amount of pressure sufficient to communicate at least a portion of fluid from a fluid repository through a dispensing orifice. In other embodiments, the threshold fluid pressure is the pressure sufficient to communicate a cosmetic-related compound, substance, or fluid from the fluid repository through the applicator. In various embodiments described herein, an apparatus may be structured to communicate fluid at a threshold fluid pressure that does not exceed a pressure applied to the fluid repository. In certain embodiments, an apparatus may be structured to communicate fluid at a threshold fluid pressure independent of a pressure applied to the fluid repository. In other words, certain embodiments of the invention resist allowing excessive applied pressure to significantly impact the dispensing or fluid application performance of a fluid dispensing apparatus.

In various embodiments, the structures, tools, and techniques described herein can be configured to be aesthetically pleasing with respect to a fluid container. This permits the structure and aesthetics (e.g., color, shape, size, and other characteristics) of the container to remain appealing in the eyes of consumers examining the container from an external point of view. In addition, aspects of the present invention can be readily retrofitted to pre-existing, standard styles of fluid containers, such as tube-type cosmetic containers, for example.

As applied herein, the term "cosmetic" may include make-up, oils, creams, and a variety of other compositions of matter capable of application by an applicator tip, for example, from a fluid dispensing apparatus or a fluid container, either naturally (e.g., by force of gravity) or by application of a threshold fluid pressure.

In various embodiments, structures described herein may comprise a foam material such as an open-cell foam material, for example. In other embodiments, one or more portions of the structures or devices described herein may comprise a porous plastic or polymer substance such as products offered in connection with the "POREX" trade designation (Porex Corporation, Fairburn, Ga.), for example. Various structures, apparatuses, and other materials described herein may be comprised of a suitable material such as polypropylene or an elastomeric material, for example. Fluid communication materials which may be applied to certain embodiments described herein include, for example and without limitation, ultra-high molecular weight polyethylene (UHMWPE), high-density polyethylene (HDPE), polypropylene (PP), polytetrafluoroethylene (PTFE), polyvinylidene fluoride (PVDF), ethylene vinyl acetate (EVA), polyethersulfone (PES), polyurethane (PU), PE/PP co-polymer, and porous varieties thereof. It can be appreciated that materials that comprise the various structures described herein can be selected for their rigidity, flexibility, pore size or dimension, and/or suitability for use within a consumer product. For example, in the context of a fluid communication material, different regions of the material may include differently sized or dimensioned pores. In other embodiments, the pore size or dimension for a fluid communication material may be substantially uniform throughout the material.

Figure 1B:
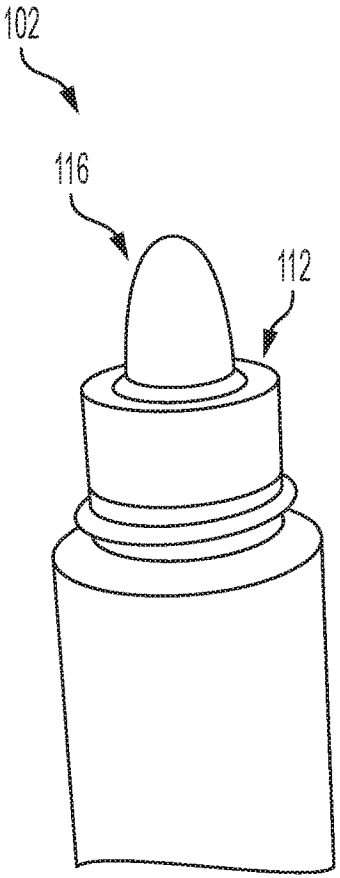
FIG. 1B includes a perspective view of the fluid dispensing apparatus of FIG. 1A with the cap removed.
Figure 1A:
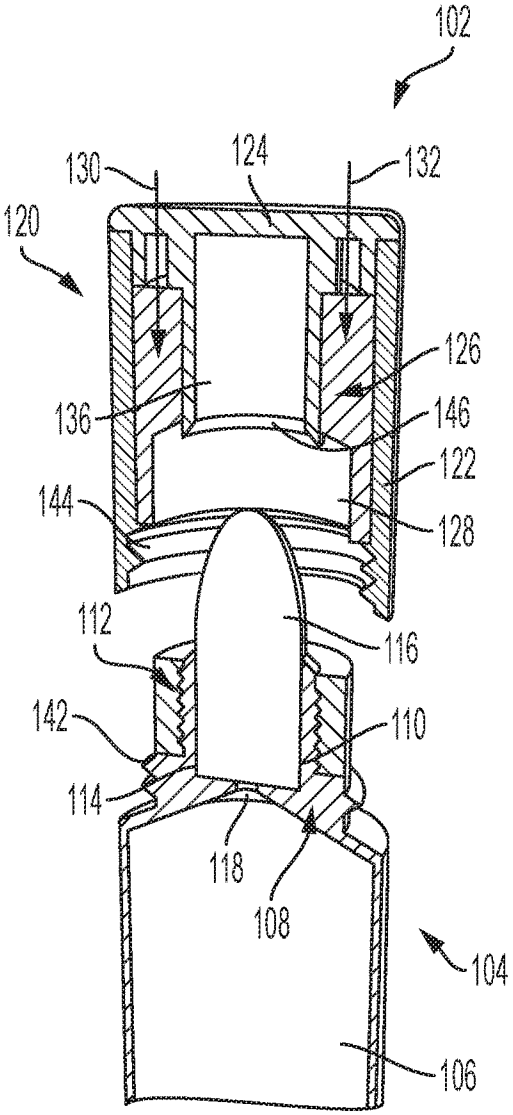
FIG. 1A includes a sectional view of an example of a fluid dispensing apparatus.

FIGS. 1A, 1B, and 2 illustrate an example of a fluid dispensing apparatus 102 which can be provided in accordance with various embodiments of the invention. As shown, the apparatus 102 includes a main body portion 104 having a fluid reservoir 106 for storage of a fluid therein. In certain embodiments, the main body portion 104 may comprise a generally tube-shaped structure. The main body portion 104 includes a head 108 having a threaded region 110 for receiving a sleeve 112 thereon. The sleeve 112 may be likewise threaded for corresponding engagement and securement with the threaded region 110 of the head 108. The head 108 may further include an inner cavity 114 structured to receive a tip 116 therein. In certain embodiments, the tip 116 may be formed in a brush or bullet shape, for example, with a radiused portion at the distal end of the tip 116. In certain embodiments, the tip 116 may be secured within the inner cavity 114 by a friction fit or other suitable means for securing the tip 116 within the inner cavity 114. When assembled in place, the tip 116 communicates fluidically with the fluid reservoir 106 through an orifice 118 formed between the inner cavity 114 of the head 108 and the fluid reservoir 106.

The apparatus 102 may also include a cap 120 comprising a main cap portion 122 and an overcap portion 124. As shown, the overcap portion 124 may be received into place via a friction fit, for example, with the main cap portion 122 to form the overall cap 120 structure. In certain embodiments, the cap 120 may be formed as a single, integral component instead of as separate components. A cap reservoir 126 may be positioned within the cap 120 which has a cavity 128 structured to correspondingly align with the sleeve 112 positioned on the tube head 108. During assembly of the cap 120, the cap reservoir 126 may be positioned within the main cap portion 122 (in the direction of arrows 130, 132, as shown) prior to installation of the overcap portion 124 onto the main cap portion 122. In certain embodiments, a lip 134 may be formed in the cap 120 wherein the lip 134 is structured to receive and rest the cap reservoir 126 thereon.

In certain embodiments, the cap 120 may include a tip cavity 136 structured to receive and correspondingly align with the tip 116 of the head 108. As shown in FIG. 2, the cap 120 and the main body portion 104 of the apparatus 102 may be assembled together by use of correspondingly mating threaded portions 142, 144 formed on the head 108 and the cap 120 (respectively). In certain embodiments, the tip cavity 136 may include a circumferential bevel 146 structured to correspondingly mate with a bevel 148 formed circumferentially around a top portion of the head 108.

In various embodiments, each of the brush tip 116, the sleeve 112, and the reservoir 126 may be comprised of a trade-designated "POREX" fluid communication material, for example, or another similar material which is suitable for receiving and retaining an oil-based fluid therein.

Figure 4:
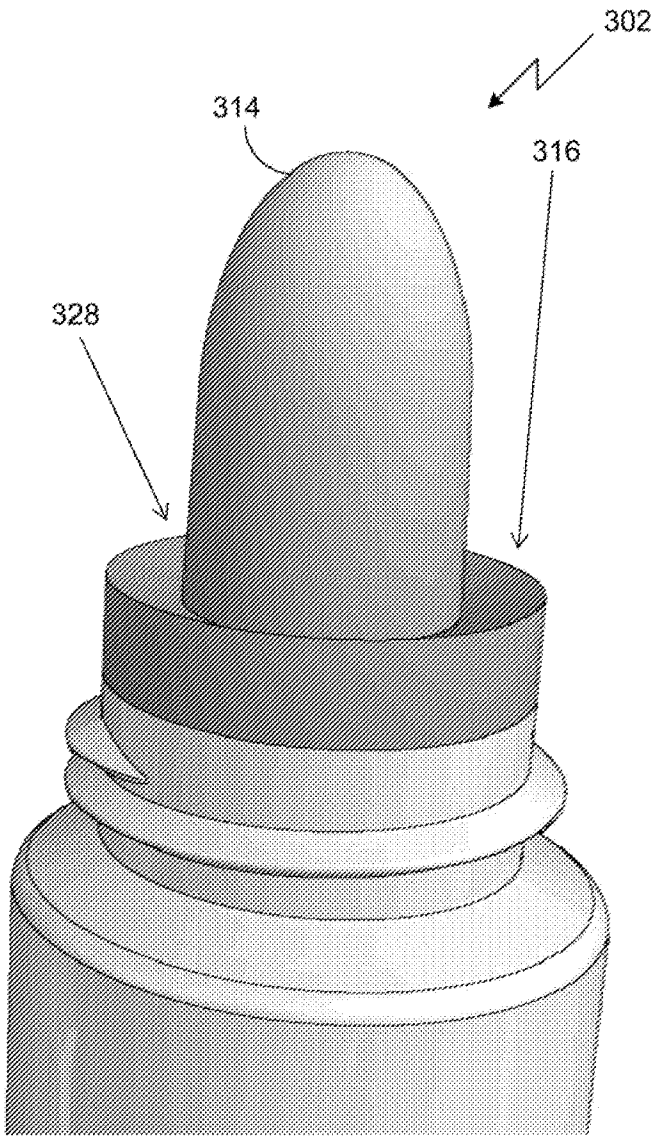
FIG. 4 includes a perspective view of the fluid dispensing apparatus of FIG. 3.
Figure 3:
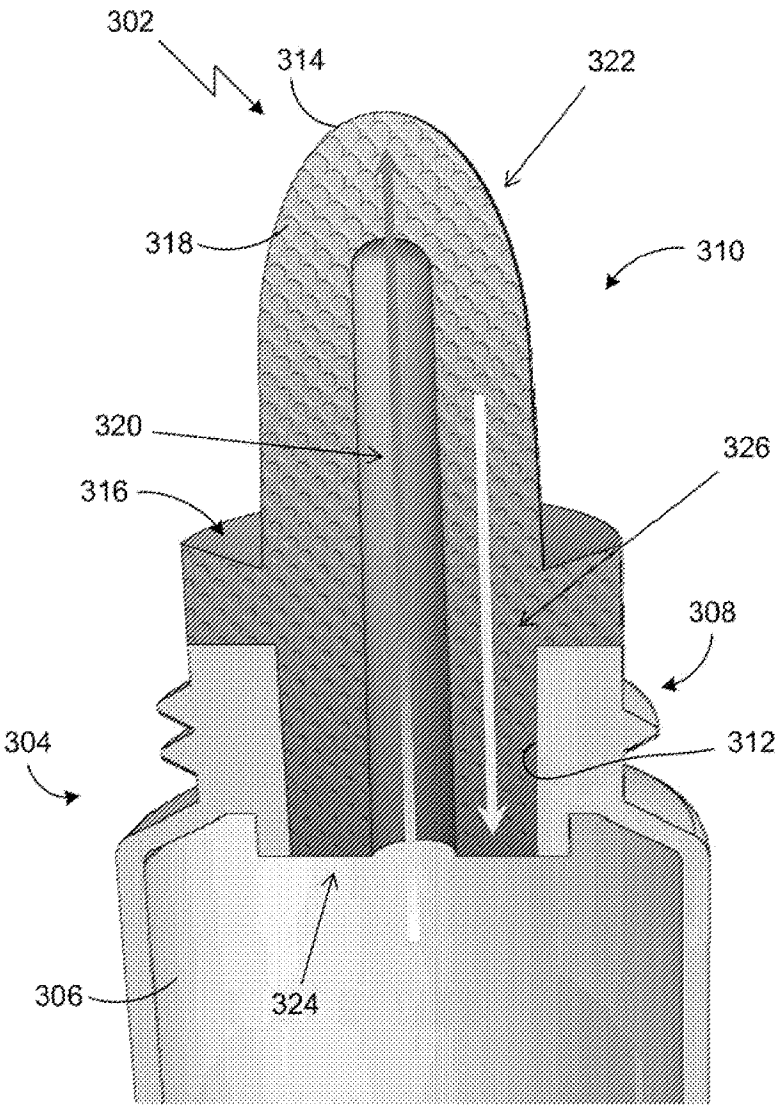
FIG. 3 includes a sectional view of an example of a fluid dispensing apparatus.

FIGS. 3 and 4 illustrate an example of a fluid dispensing apparatus 302 which can be provided in accordance with various embodiments of the invention. The apparatus 302 includes a main body portion 304 having a fluid reservoir 306 and a dispensing head 308. As shown, the apparatus 302 may also include a tip 310 positioned within an inner cavity 312 of the head 308. The tip 310 may include a main body portion 314 and an integrally formed collar 316 positioned around the outside of the main body portion 314 of the tip 310.

The tip 310 may be comprised of a fluid communication material which may be a trade-designated "POREX" material, for example. In certain embodiments, the tip 310 may be comprised of a similar material which is suitable for receiving and retaining an oil-based fluid therein, for example, and for communicating such fluid through one or more pores 318 contained within the material. The tip 310 may further comprise a channel 320 for communicating fluid from the fluid reservoir 306 to a distal end of the tip 310, which promotes dispensing fluid at the distal end of the tip 310 and resists dispensing fluid through the collar 316, for example. The tip 310 may further include a large pore region 322 and a small pore region 324 which promotes wicking of fluid from the large pore region 322 to the small pore region 324 when the apparatus 302 is not in use for dispensing fluid, for example. The tip 310 may be structured to wick oil in the direction of arrow 326, as shown, when the apparatus 302 is not in use. In certain embodiments, this arrangement may be reversed such that the locations of the pore regions 322, 324 can be exchanged. For example, the large pore region 322 may be located near the main body portion 314 of the tip 310; and the small pore region 324 may be located near the distal end of the tip 310. Accordingly, the tip 310 may be structured to wick oil in the opposite direction of arrow 326, for example.

As illustrated more particularly in FIG. 4, the tip 310 may further include a trough 328 configured to catch drips or other excess fluid occasioned by use of the apparatus 302. The trough 328 may be configured to slant angularly downward from an outside circumference of the trough 328 toward a central portion of the tip 310.

Figure 6:
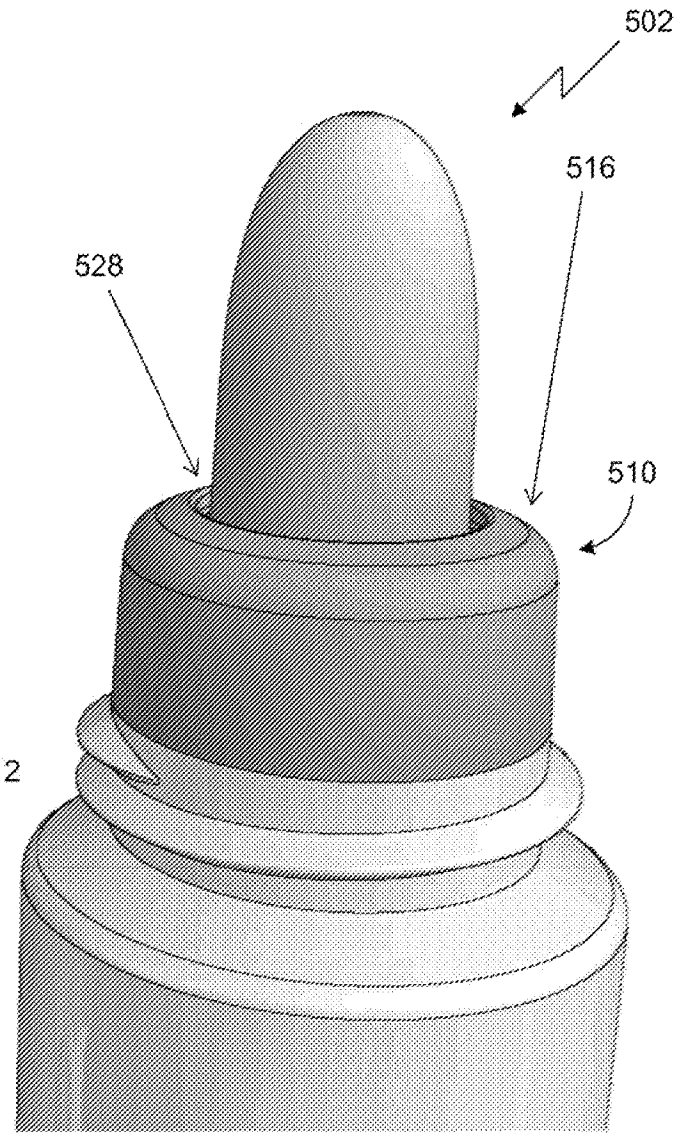
FIG. 6 includes a perspective view of the fluid dispensing apparatus of FIG. 5.
Figure 5:
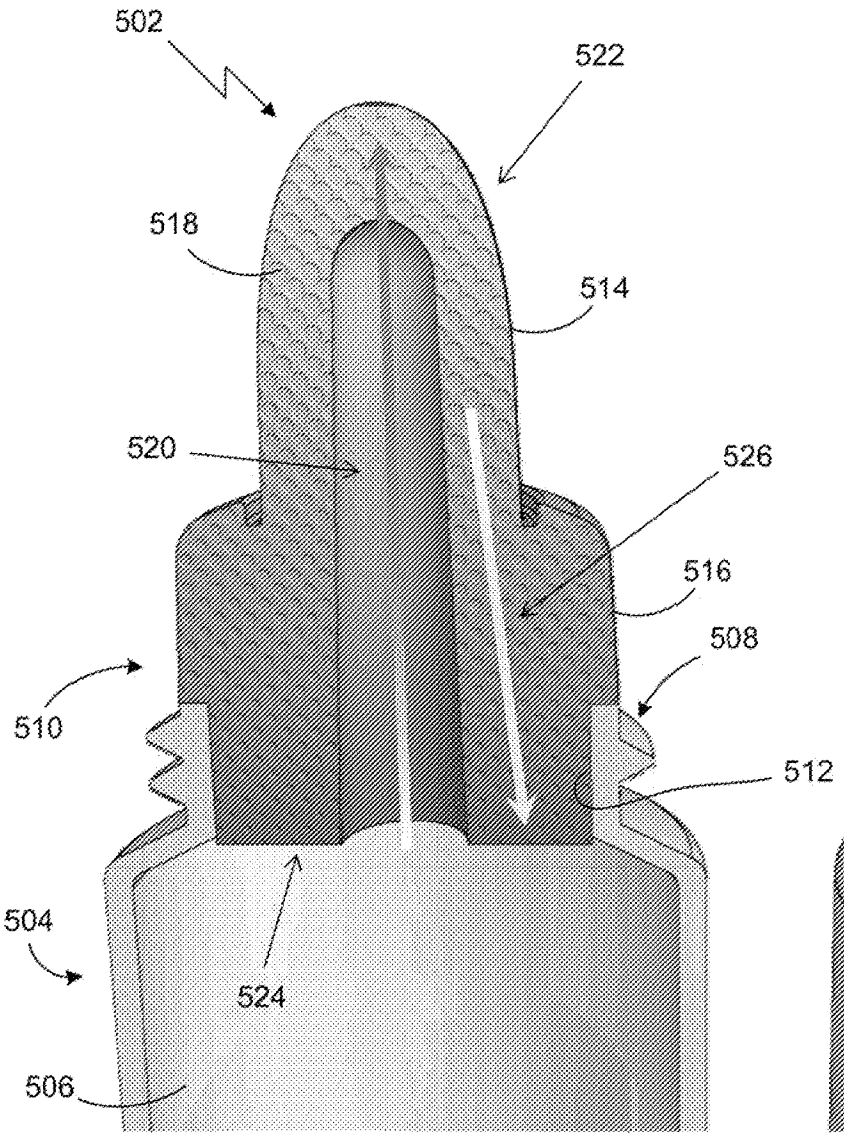
FIG. 5 includes a sectional view of an example of a fluid dispensing apparatus.

FIGS. 5 and 6 illustrate an example of a fluid dispensing apparatus 502 which can be provided in accordance with various embodiments of the invention. The apparatus 502 includes a main body portion 504 having a fluid reservoir 506 and a head 508. As shown, the apparatus 502 may also include a tip 510 positioned within an inner cavity 512 of the head 508. The tip 510 may include a main body portion 514 and an integrally formed collar 516 positioned around the outside of the main body portion 514 of the tip 510.

The tip 510 may be comprised of a fluid communication material which may be a trade-designated "POREX" material, for example. In certain embodiments, the tip 510 may be comprised of a similar material which is suitable for receiving and retaining an oil-based fluid therein, for example, and for communicating such fluid through one or more pores 518 contained within the material. The tip 510 may further comprise a channel 520 for communicating fluid from the fluid reservoir 506 to a distal end of the tip 510, which promotes dispensing fluid at the distal end of the tip 510 and resists dispensing fluid through the collar 516, for example. The tip 510 may further include a large pore region 522 and a small pore region 524 which promotes wicking of fluid from the large pore region 522 to the small pore region 524 when the apparatus 502 is not in use for dispensing fluid, for example. The tip 510 may be structured to wick oil in the direction of arrow 526, as shown, when the apparatus 502 is not in use. In certain embodiments, this arrangement may be reversed such that the locations of the pore regions 522, 524 can be exchanged. For example, the large pore region 522 may be located near the main body portion 514 of the tip 510; and the small pore region 524 may be located near the distal end of the tip 510. Accordingly, the tip 510 may be structured to wick oil in the opposite direction of arrow 526, for example.

As illustrated more particularly in FIG. 6, the tip 510 may further include a trough 528 configured to catch drips or other excess fluid occasioned by use of the apparatus 502. The trough 528 may be configured to slant angularly downward from an outside circumference of the trough 528 toward a central portion of the tip 510. In certain embodiments, the collar 516 may be structured with a radiused profile which descends or slopes generally downwardly away from the main portion 514 of the tip 510, as shown in FIG. 6.

Figure 8:
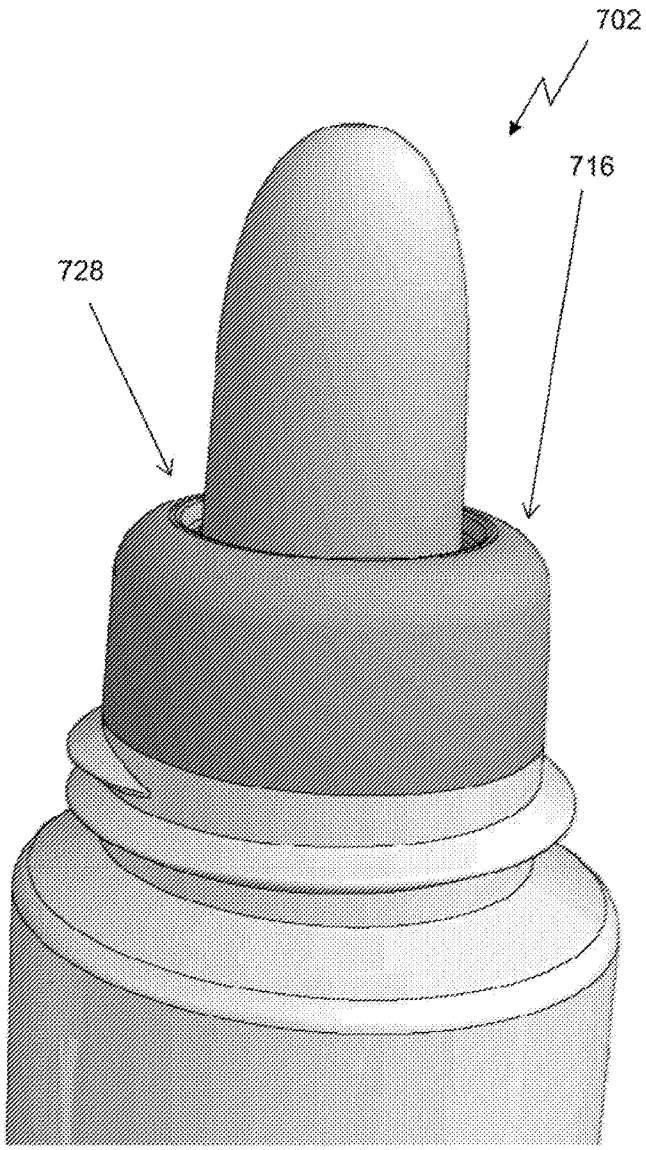
FIG. 8 includes a perspective view of the fluid dispensing apparatus of FIG. 7.
Figure 7:
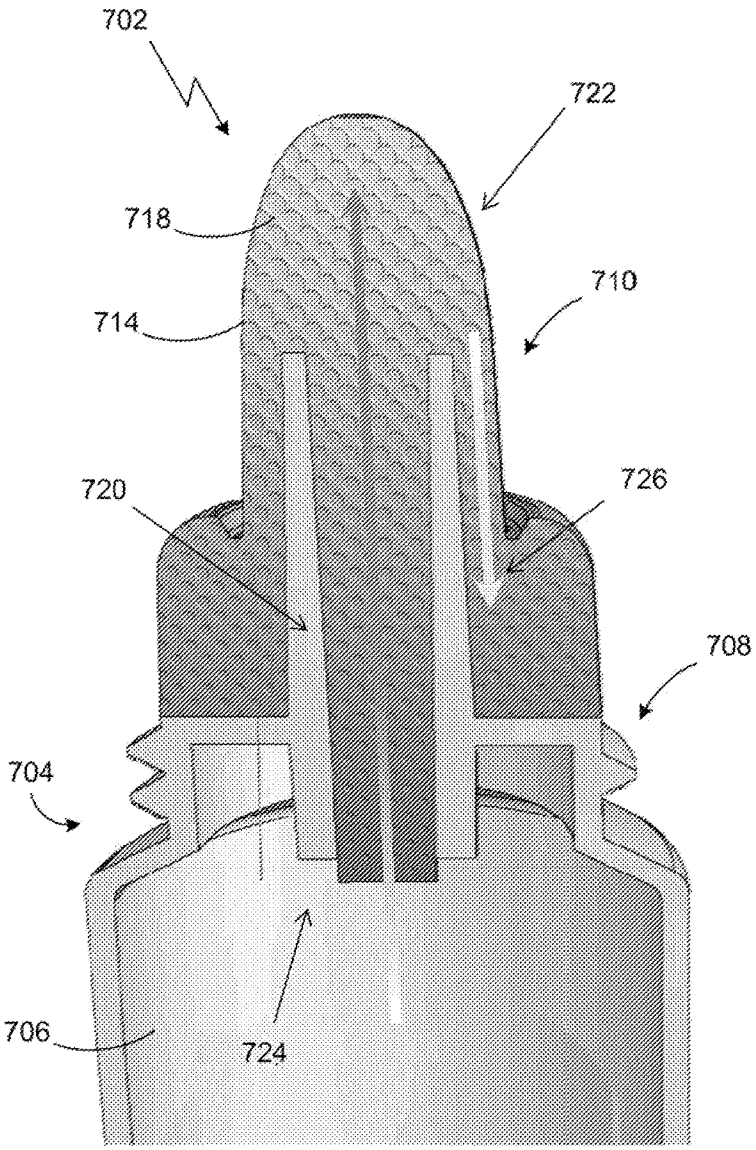
FIG. 7 includes a sectional view of an example of a fluid dispensing apparatus.

FIGS. 7 and 8 illustrate an example of a fluid dispensing apparatus 702 which can be provided in accordance with various embodiments of the invention. The apparatus 702 includes a main body portion 704 having a fluid reservoir 706 and a dispensing head 708. As shown, the apparatus 702 may also include a tip 710 positioned on a distal portion of the head 708. The tip 710 may include a main body portion 714 and an integrally formed collar 716 positioned around the outside of the main body portion 714 of the tip 710.

The tip 710 may be comprised of a fluid communication material which may be a trade-designated "POREX" material, for example. In certain embodiments, the tip 710 may be comprised of a similar material which is suitable for receiving and retaining an oil-based fluid therein, for example, and for communicating such fluid through one or more pores 718 contained within the material. The head 708 of the apparatus 702 may include an extended orifice 720 structured to communicate fluid from the reservoir 706 through the extended orifice 720 and onward to the distal end of the tip 710. It can be seen that the extended orifice 720 provides a pathway for directing fluid flow from the reservoir 706 to the tip 710. The tip 710 may further include a large pore region 722 and a small pore region 724 which promotes wicking of fluid from the large pore region 722 to the small pore region 724 when the apparatus 702 is not in use for dispensing fluid, for example. The tip 710 may be structured to wick oil in the direction of arrow 726, as shown, when the apparatus 702 is not in use. In certain embodiments, this arrangement may be reversed such that the locations of the pore regions 722, 724 can be exchanged. For example, the large pore region 722 may be located near the main body portion 714 of the tip 710; and the small pore region 724 may be located near the distal end of the tip 710. Accordingly, the tip 710 may be structured to wick oil in the opposite direction of arrow 726, for example.

As illustrated more particularly in FIG. 8, the tip 710 may further include a trough 728 configured to catch drips or other excess fluid occasioned by use of the apparatus 702. The trough 728 may be configured to slant angularly downward from an outside circumference of the trough 728 toward a central portion of the tip 710, as shown. In certain embodiments, the collar 716 may be structured with a radiused profile which descends or slopes generally downwardly away from the main portion 714 of the tip 710, as shown in FIG. 8.

Figures 9, 10, 11:
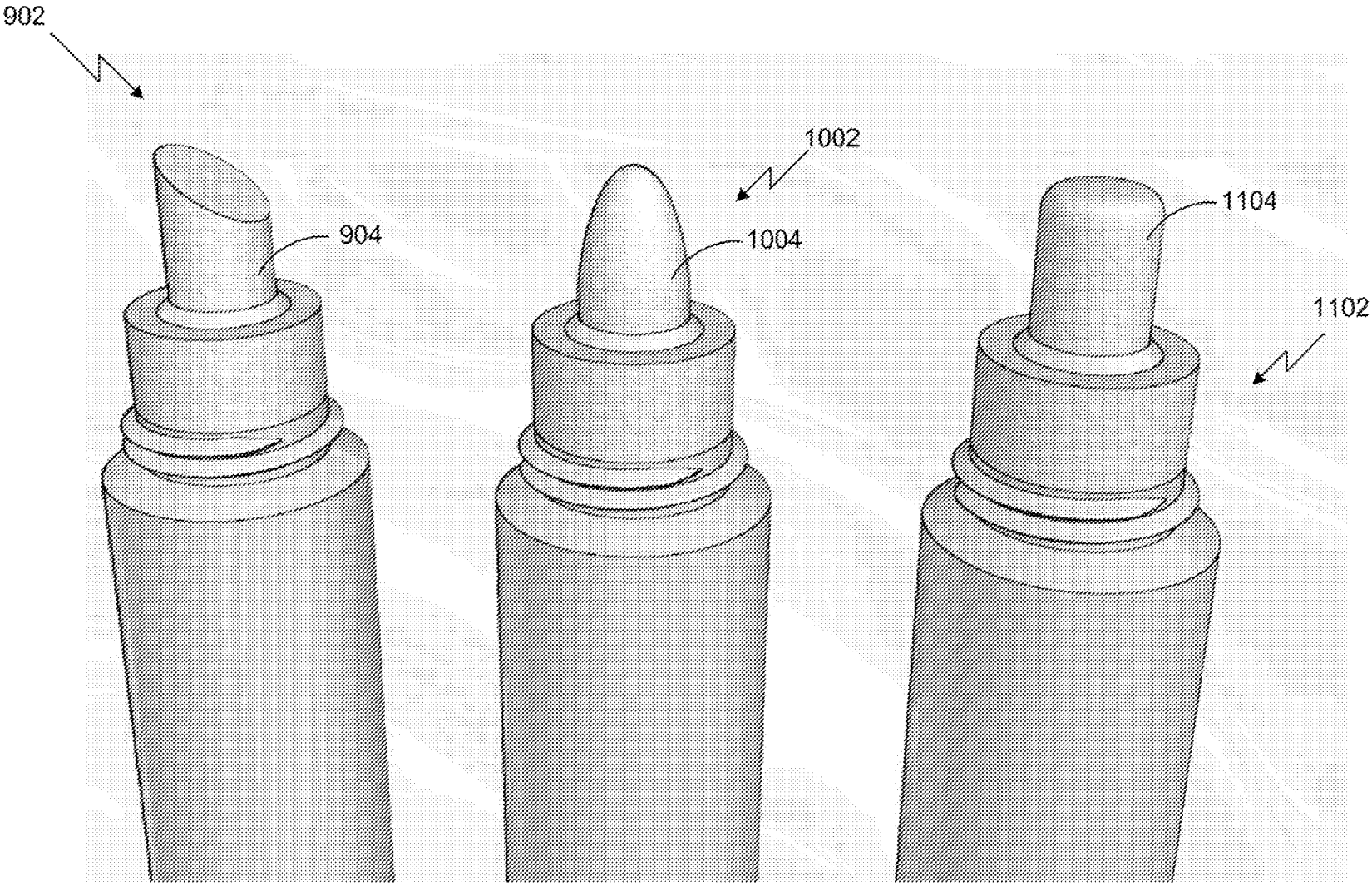
FIG. 9 includes a perspective view of an example of a fluid dispensing apparatus.
FIG. 10 includes a perspective view of an example of a fluid dispensing apparatus.
FIG. 11 includes a perspective view of an example of a fluid dispensing apparatus.
Figures 12, 13, 14:
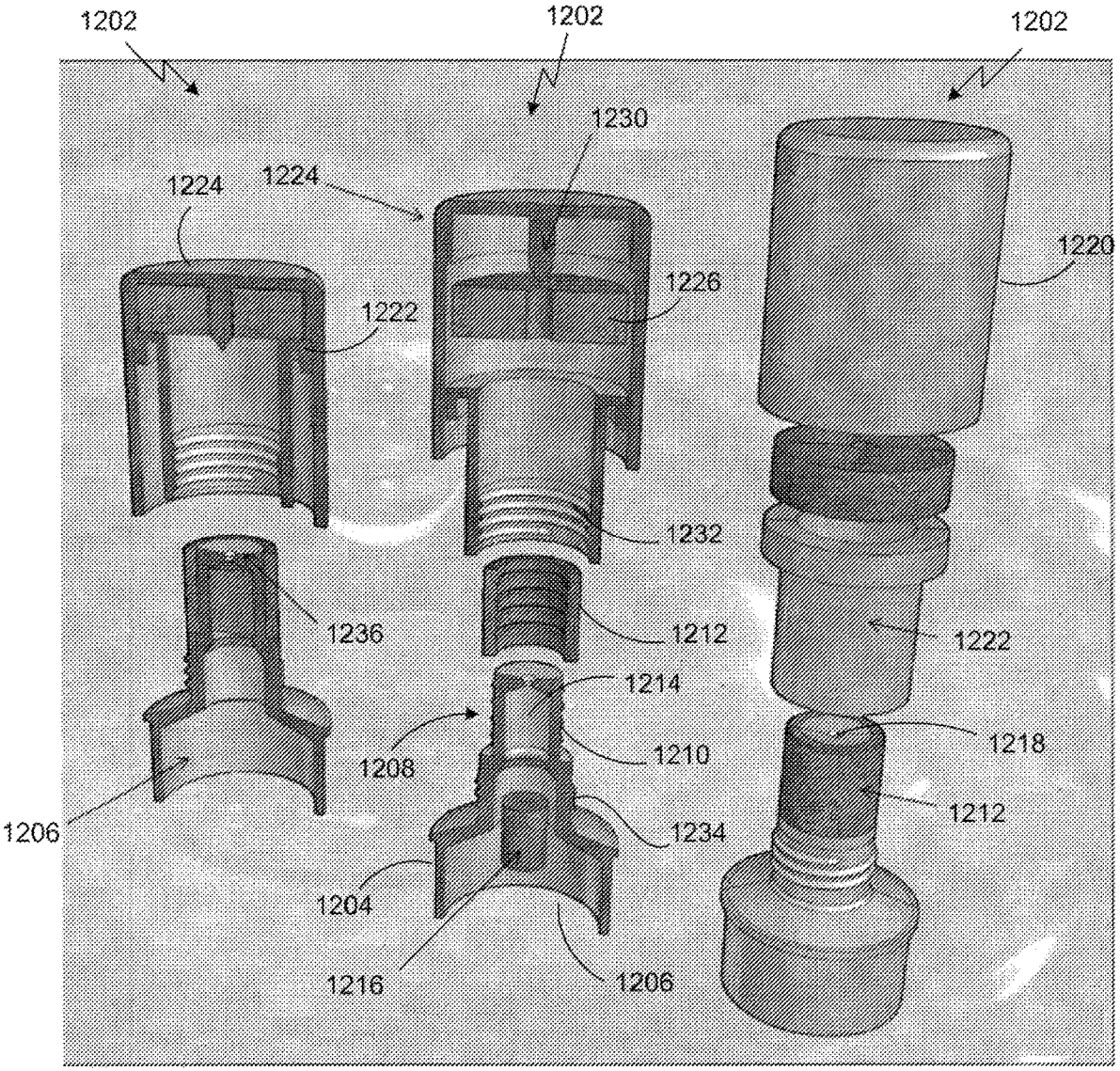
FIG. 12 includes a partially exploded sectional view of an example of a fluid dispensing apparatus.
FIG. 13 includes an exploded sectional view of the fluid dispensing apparatus of FIG. 12.
FIG. 14 includes an exploded perspective view of the fluid dispensing apparatus of FIG. 12.

With reference to FIGS. 9-11, various examples of different tips or applicators are illustrated which can be employed in association with various embodiments of the invention. FIG. 9 illustrates an example of a dispensing apparatus 902 having an angled dabber applicator 904 which can be used for the lips of a user, for example, or other multi-purpose uses. The dabber applicator 904 may be used to dispense fluid into wrinkles or larger surface areas of the face or body of a user, for example. FIG. 10 illustrates an example of a dispensing apparatus 1002 having a bullet-shaped dabber applicator 1004 which can be used to dispense fluid into more delicate or smaller surface areas of the face or body of a user, for example. FIG. 11 illustrates an example of a dispensing apparatus 1102 having a blunt dabber applicator 1104 which can be used for multi-purpose sampling of skin oils and lighter serums, for example.

FIGS. 12-16 illustrate an example of a fluid dispensing apparatus 1202 which can be provided in accordance with various embodiments of the invention. As shown, the apparatus 1202 includes a main body portion 1204 having a fluid reservoir 1206 for storage of a fluid therein. In certain embodiments, the main body portion 1204 may comprise a generally tube-shaped structure. The main body portion 1204 includes a head 1208 having a threaded region 1210 for receiving a sleeve 1212 thereon. The sleeve 1212 may be likewise threaded for corresponding engagement and securement with the threaded region 1210 of the head 1208. The head 1208 may further include an inner cavity 1214 structured to receive a plug 1216 therein. In certain embodiments, the plug 1216 may be secured within the inner cavity 1214 by a friction fit or other suitable means for securing the plug 1216 within the inner cavity 1214. When assembled in place, the plug 1216 communicates fluidically with the fluid reservoir 1206 and can dispense fluid through an orifice 1218 formed in a distal portion of the head 1208 when threshold pressure is applied to the apparatus 1202, such as by manual force applied by a user.

The apparatus 1202 may also include a cap 1220 comprising an inner cap 1222 and an overcap 1224. As shown, the overcap 1224 may receive the inner cap 1222 into place via a friction fit, for example, to form the overall cap 1220 structure. A cap reservoir 1226 may be provided as a generally disc-shaped component having a central opening 1228 structured to receive a pintel 1230 of the overcap 1224 therethrough. It can be seen that the pintel 1230 serves to secure the cap reservoir 1226 within the overcap 1224 during assembly and use of the apparatus 1202. During assembly of the cap 1220, the inner cap 1222 may be pressed into the overcap 1224 which forces the cap reservoir 1226 to engage the pintel 1230, thereby sandwiching the cap reservoir between a top surface of the inner cap 1222 and an interior surface of the overcap 1224. In certain embodiments, the inner cap 1222 may include a threaded region 1232 structured to correspondingly engage a threaded region 1234 of the head 1208 when the cap 1222 is secured and closed on the apparatus 1202. In certain embodiments, the head 1208 may include a dished-in tip 1236 which angles inwardly downwardly from an outside circumference of the tip 1236 toward the orifice 1218. This facilitates returning excess fluid to the orifice 1218 and ultimately back to the fluid reservoir 1206 of the apparatus 1202.

In various embodiments, each of the sleeve 1212 and/or the cap reservoir 1226 may be comprised of a trade-designated "POREX" fluid communication material, for example, or another similar material which is suitable for receiving and retaining an oil-based fluid therein. The plug 1216 may be comprised of a foam material such as an open-cell foam material, for example.

Figures 15, 16:
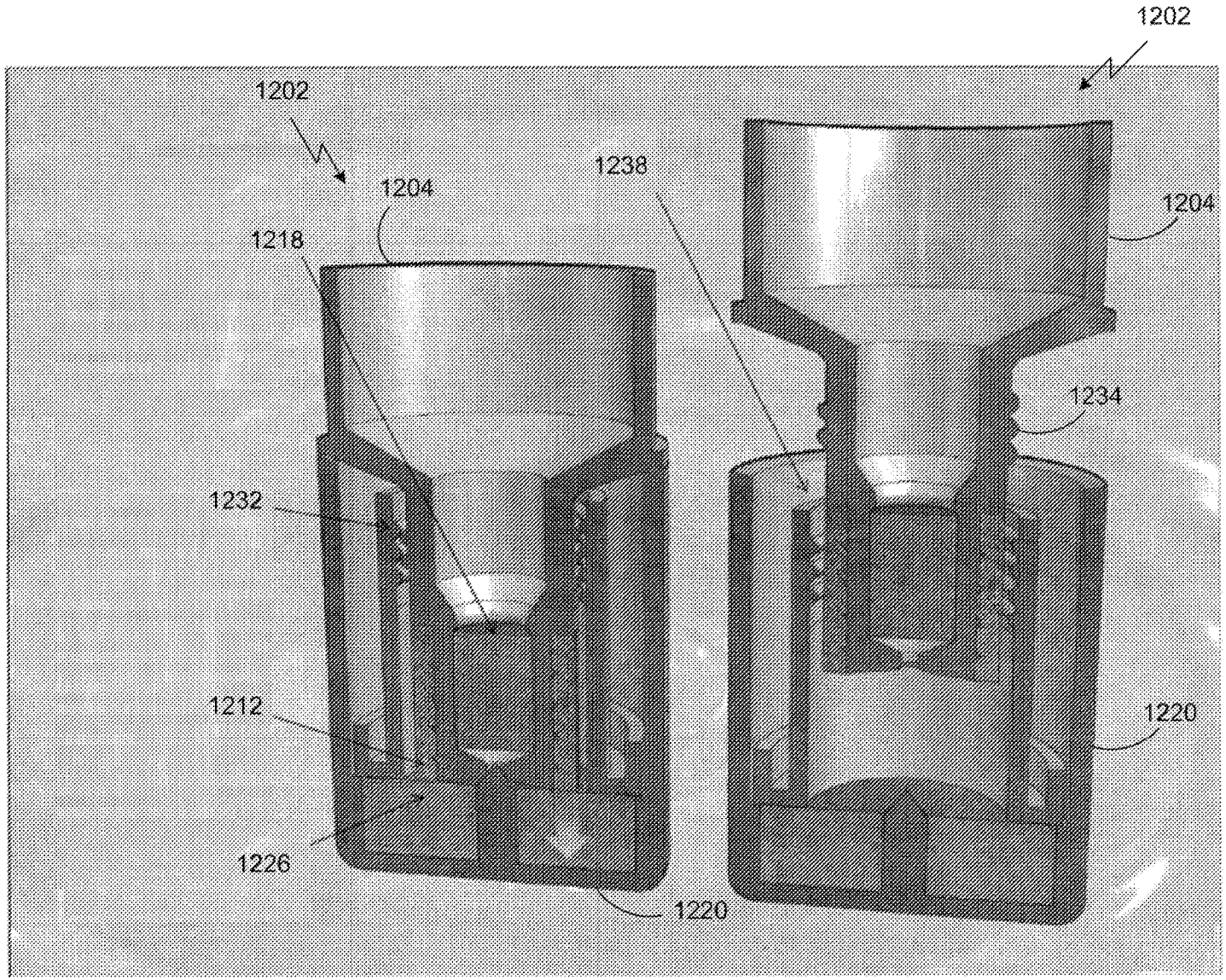
FIG. 15 includes an inverted sectional view of the fluid dispensing apparatus of FIG. 12.
FIG. 16 includes an inverted, partially exploded sectional view of the fluid dispensing apparatus of FIG. 12.

As shown more particularly in FIGS. 15 and 16, in an inverted view of the apparatus 1202, the cap reservoir 1226 functions to wick fluid (e.g., an oil-based fluid) from the sleeve 1212 to the cap reservoir 1226. When the apparatus 1202 is in a closed position (inverted as shown in FIGS. 15 and 16), oil-based fluid can wick from areas of low porosity (e.g., sleeve 1212) to areas of high porosity (e.g., cap reservoir 1226). Accordingly, the sleeve 1212 may be comprised of a material which is comparatively lower porosity in comparison to a material which comprises the cap reservoir 1226. Contact between the sleeve 1212 and the cap reservoir 1226 in the closed position of the apparatus 1202 facilitates the fluid flow between these components 1212, 1226. It can be seen that gravity may assist with the wicking process, particularly in an inverted position of the apparatus 1202, as shown. In other aspects of the invention, the threaded regions 1232, 1234 can be positioned remotely with respect to the orifice 1218 location to resist exposure to fluid by the threaded regions 1232, 1234. It can also be seen that providing a gap distance 1238 or clearance between the threaded regions 1232, 1234 further promotes avoiding fluid retention on the threaded regions 1232, 1234, such as might be occasioned by proximity of the threaded region 1232 to the sleeve 1212, for example. In certain embodiments, the plug 1216 resists oil from gushing or inadvertently dripping during use or during non-use handling, for example.

Figure 17:
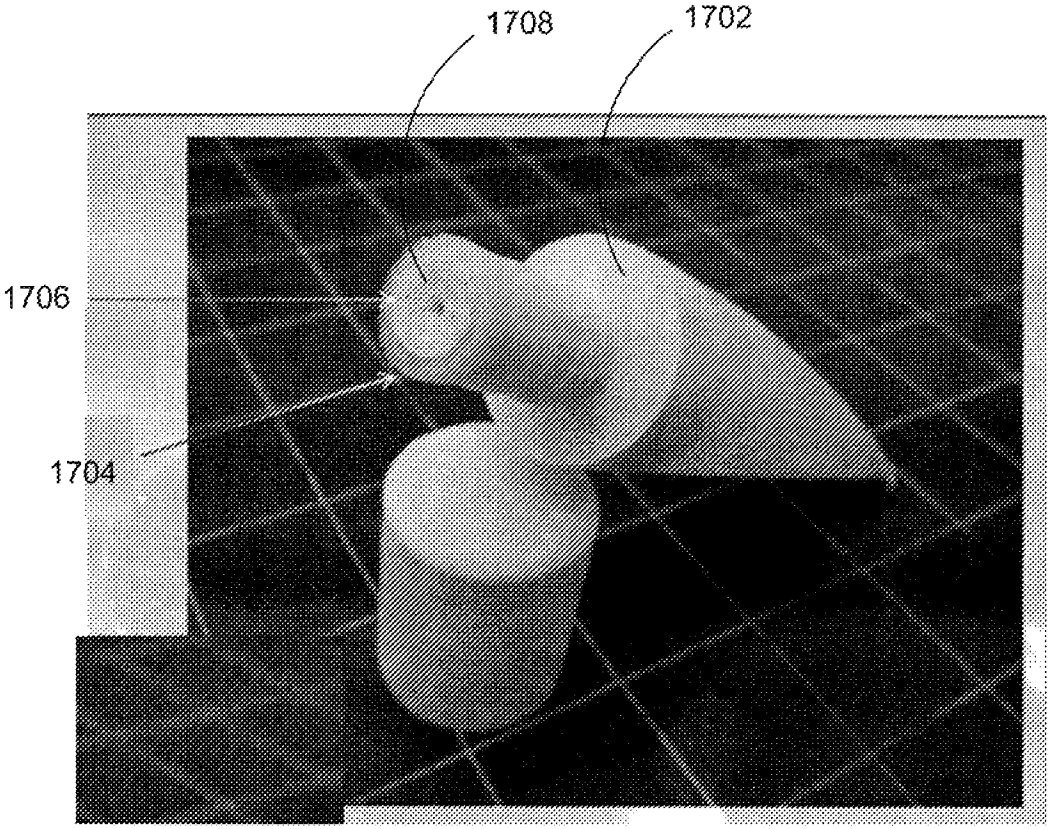
FIG. 17 illustrates an example of a fluid dispensing apparatus.
Figures 18, 19, 20:
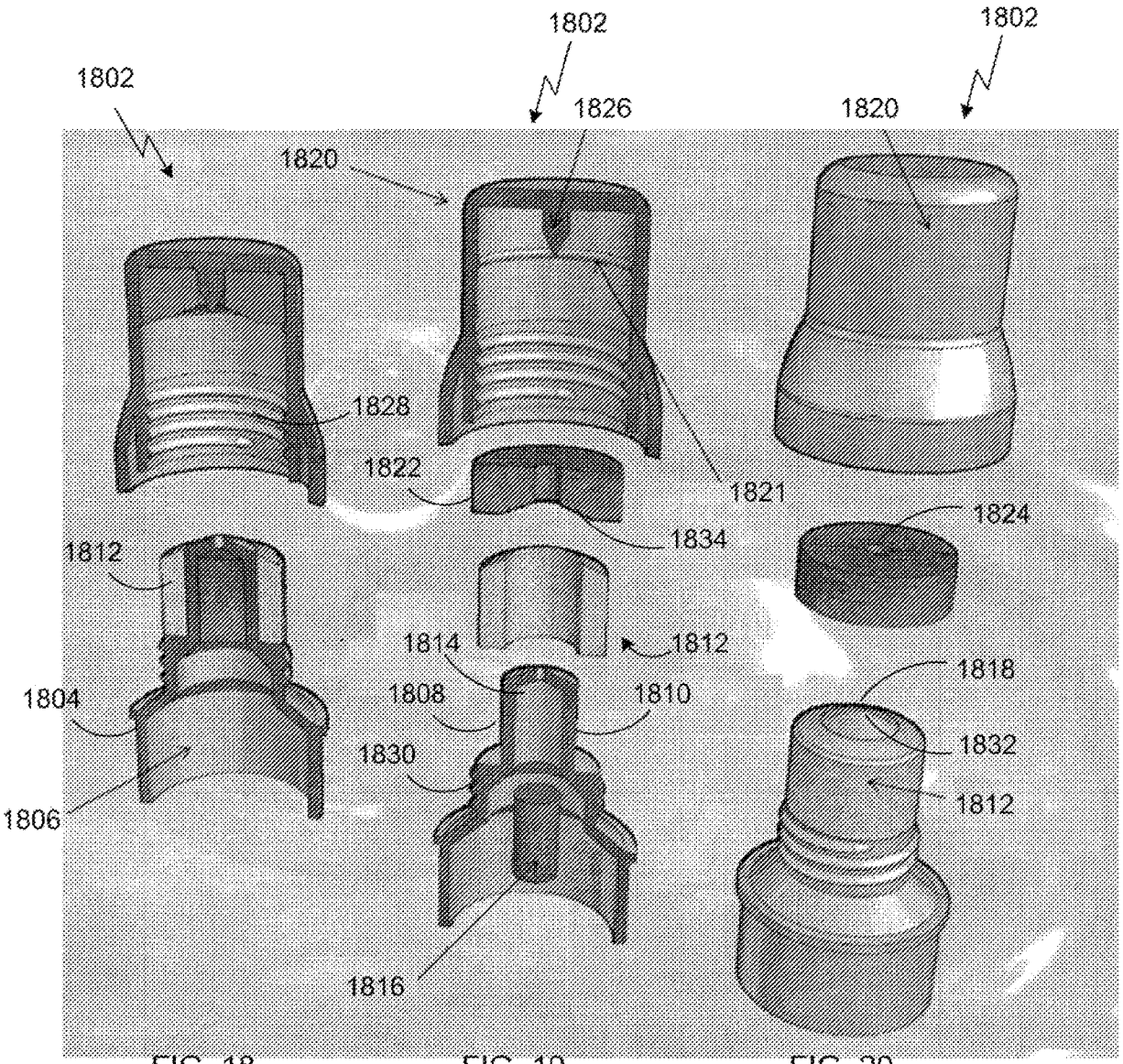
FIG. 18 includes a partially exploded sectional view of an example of a fluid dispensing apparatus.
FIG. 19 includes an exploded sectional view of the fluid dispensing apparatus of FIG. 18.
FIG. 20 includes an exploded perspective view of the fluid dispensing apparatus of FIG. 18.

With reference to FIG. 17, in various embodiments a fluid dispensing apparatus 1702 may include a head 1704 having a dished-in orifice 1706 at a tip of the head 1704. One or more concentric ribs 1708 may be positioned around the orifice 1706 to facilitate retaining oil-based fluid in place on the head 1704.

FIGS. 18-22 illustrate an example of a fluid dispensing apparatus 1802 which can be provided in accordance with various embodiments of the invention. As shown, the apparatus 1802 includes a main body portion 1804 having a fluid reservoir 1806 for storage of a fluid therein. In certain embodiments, the main body portion 1804 may comprise a generally tube-shaped structure. The main body portion 1804 includes a head 1808 having an outside surface 1810 for receiving a sleeve 1812 thereon. The sleeve 1812 may be molded into a shape which correspondingly matches the contour of the outside surface 1810 of the head 1808. In certain embodiments, the sleeve 1812 may include a top surface which slopes generally downwardly away from the top of the head 1808. The head 1808 may further include an inner cavity 1814 structured to receive a plug 1816 therein. In certain embodiments, the plug 1816 may be secured within the inner cavity 1814 by a friction fit or other suitable means for securing the plug 1816 within the inner cavity 1814. When assembled in place, the plug 1816 communicates fluidically with the fluid reservoir 1806 and can dispense fluid through an orifice 1818 formed in a distal portion of the head 1808 when threshold pressure is applied to the apparatus 1802, such as by manual force applied by a user.

The apparatus 1802 may also include a cap 1820 which may be dropper-shaped, for example, to communicate a particular mode of use for the apparatus 1802. A cap reservoir 1822 may be provided as a generally disc-shaped component having a central opening 1824 structured to receive a pintel 1826 of the cap 1820 therethrough. It can be seen that the pintel 1826 serves to secure the cap reservoir 1822 within the cap 1820 during assembly and use of the apparatus 1802. The cap 1820 may further include a circumferential ring 1821 which serves as a ledge to support the cap reservoir 1822 in position when the reservoir 1822 is installed in the cap 1820. In certain embodiments, the cap 1820 may include a threaded region 1828 structured to correspondingly engage a threaded region 1830 of the head 1808 when the cap 1820 is secured and closed on the apparatus 1802.

In certain embodiments, the head 1808 may include a generally downwardly sloping tip 1832 which slopes down and away from the orifice 1818. In combination with a flush face of the sleeve 1812, this arrangement facilitates returning excess fluid from the orifice 1818 to the sleeve 1812. In certain embodiments, the cap reservoir 1822 may include an angled surface 1834 around the circumference of the cap reservoir 1822 which is structured to correspondingly mate with the surface of the tip 1832 in a closed state of the apparatus 1802.

In various embodiments, each of the sleeve 1812 and/or the cap reservoir 1822 may be comprised of a trade-designated "POREX" fluid communication material, for example, or another similar material which is suitable for receiving and retaining an oil-based fluid therein. The plug 1816 may be comprised of a foam material such as an open-cell foam material, for example.

Figures 21, 22:
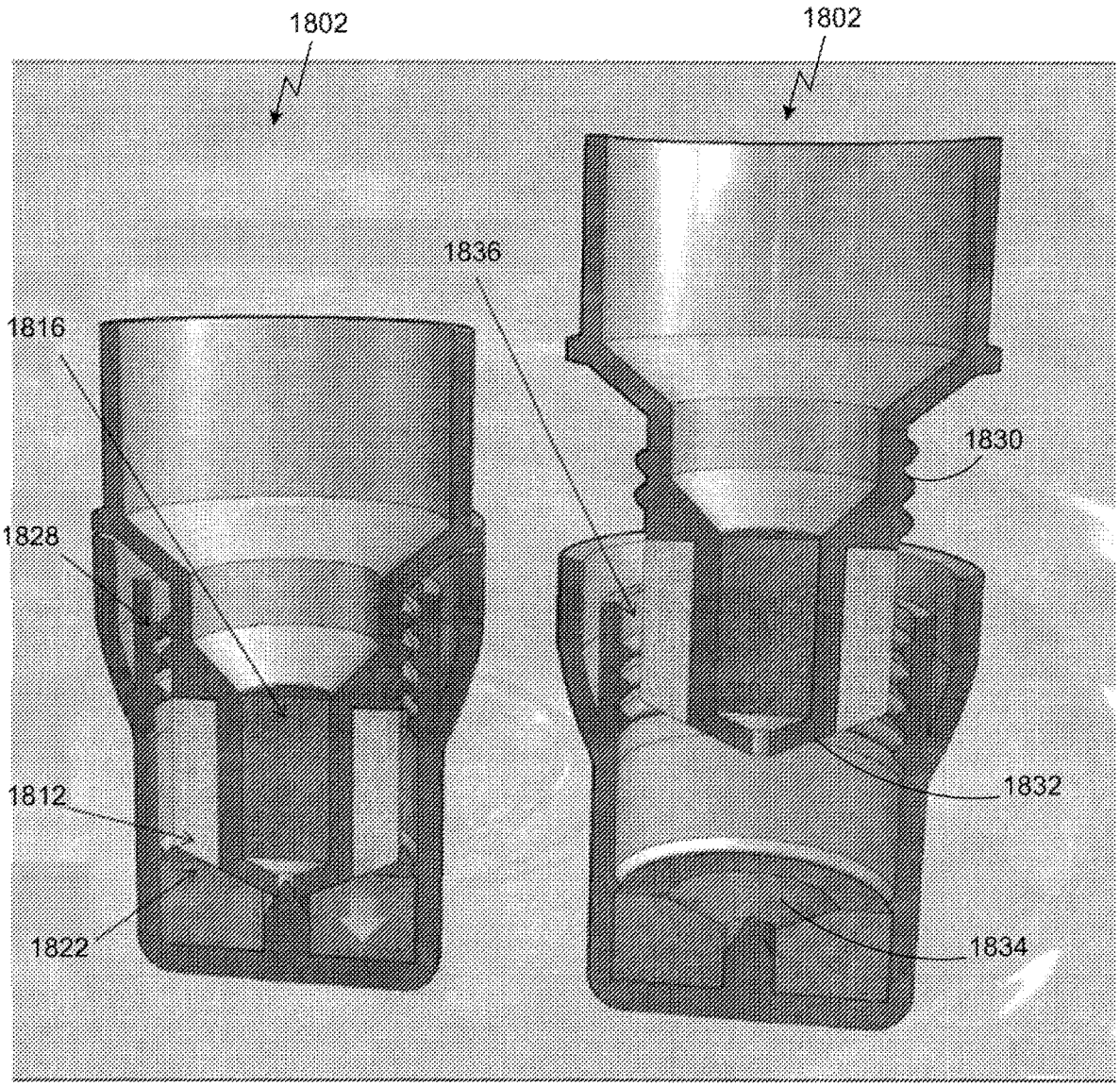
FIG. 21 includes an inverted sectional view of the fluid dispensing apparatus of FIG. 18.
FIG. 22 includes an inverted, partially exploded sectional view of the fluid dispensing apparatus of FIG. 18.
Figures 23, 24, 25:
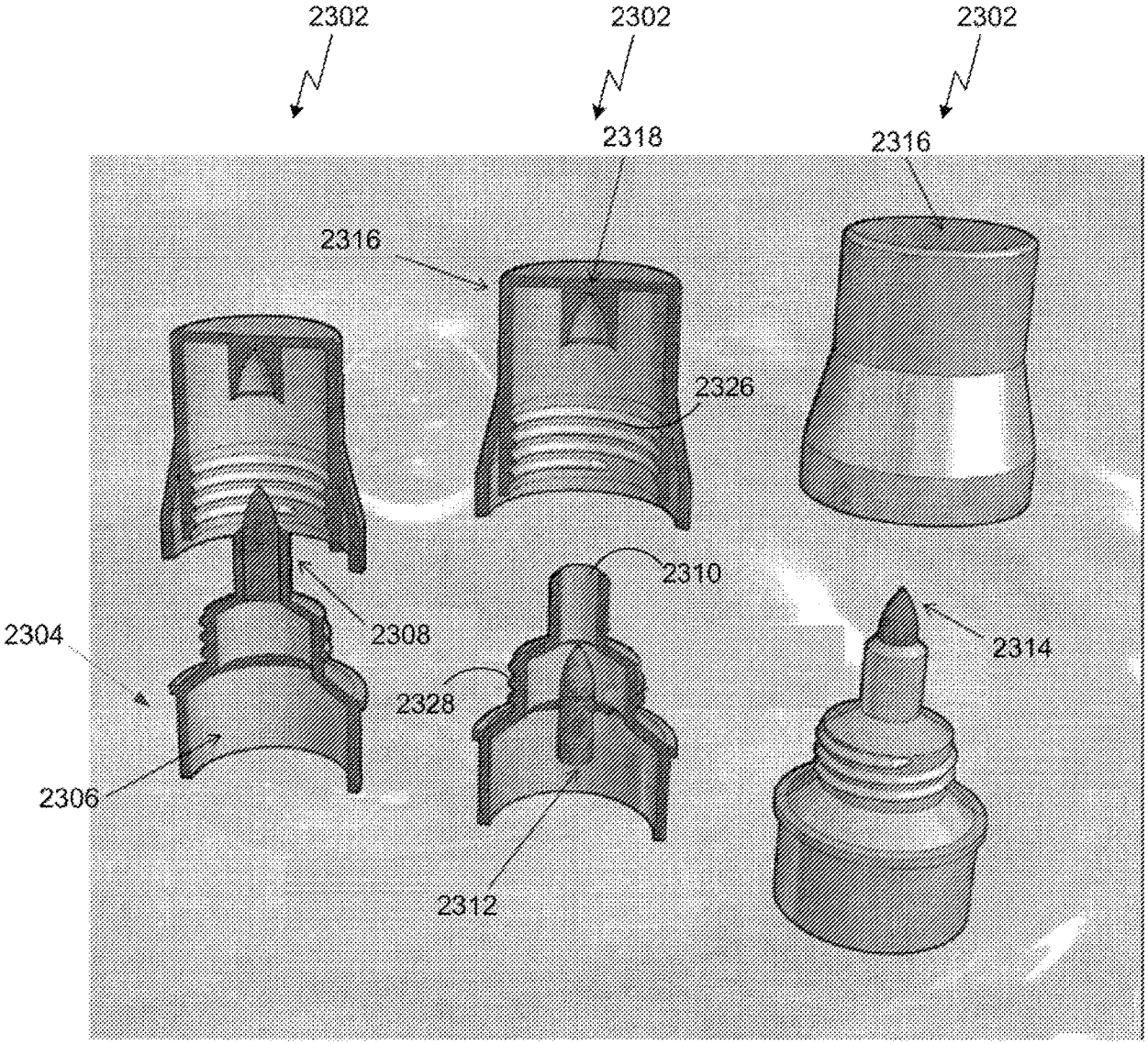
FIG. 23 includes a partially exploded sectional view of an example of a fluid dispensing apparatus.
FIG. 24 includes an exploded sectional view of the fluid dispensing apparatus of FIG. 23.
FIG. 25 includes an exploded perspective view of the fluid dispensing apparatus of FIG. 23.

As shown more particularly in FIGS. 21 and 22, in an inverted view of the apparatus 1802, the cap reservoir 1822 functions to wick fluid (e.g., an oil-based fluid) from the sleeve 1812 to the cap reservoir 1822. When the apparatus 1802 is in a closed position (inverted as shown in FIGS. 21 and 22), oil-based fluid can wick from areas of low porosity (e.g., sleeve 1812) to areas of high porosity (e.g., cap reservoir 1822). Accordingly, the sleeve 1812 may be comprised of a material which is comparatively lower porosity in comparison to a material which comprises the cap reservoir 1822. Contact between the sleeve 1812 and the cap reservoir 1822 in the closed position of the apparatus 1802 facilitates the fluid flow between these components 1812, 1822. It can be seen that gravity may assist with the wicking process, particularly in an inverted position of the apparatus 1802, as shown. In other aspects of the invention, the threaded regions 1828, 1830 can be positioned remotely with respect to the orifice 1818 location to resist exposure to fluid by the threaded regions 1828, 1830. It can also be seen that providing a gap distance 1836 or clearance between the threaded regions 1828, 1830 further promotes avoiding fluid retention on the threaded regions 1828, 1830, such as might be occasioned by proximity of the threaded region 1828 to the sleeve 1812, for example. In certain embodiments, the plug 1816 resists oil from gushing or inadvertently dripping during use or during non-use handling, for example.

FIGS. 23-27 illustrate an example of a fluid dispensing apparatus 2302 which can be provided in accordance with various embodiments of the invention. As shown, the apparatus 2302 includes a main body portion 2304 having a fluid reservoir 2306 for storage of a fluid therein. In certain embodiments, the main body portion 2304 may comprise a generally tube-shaped structure. The main body portion 2304 includes a head 2308 having an inner cavity 2310 structured for receiving a plug 2312 therein. The plug 2312 may be generally bullet-shaped or otherwise molded into a shape having a tip 2314 which is suitable for enhanced precision of application of fluid from the apparatus 2302. The plug 2312 may be positioned in the head 2308 with a friction fit, for example, or another suitable means for securing the plug 2312 within the head 2308.

The apparatus 2302 may also include a cap 2316 which may be dropper-shaped, for example, to communicate a particular mode of use for the apparatus 1802. A tip cavity 2318 may be formed in the cap 2316 and structured to receive and correspondingly mate with the shape of the tip 2314 of the plug 2312. In various embodiments, the plug 2312 may be comprised of a trade-designated "POREX" fluid communication material or another similar material which is suitable for receiving and retaining an oil-based fluid therein, for example. In certain embodiments, at least a portion of the plug 2312 may be comprised of a foam material such as an open-cell foam material, for example.

Figures 26, 27:
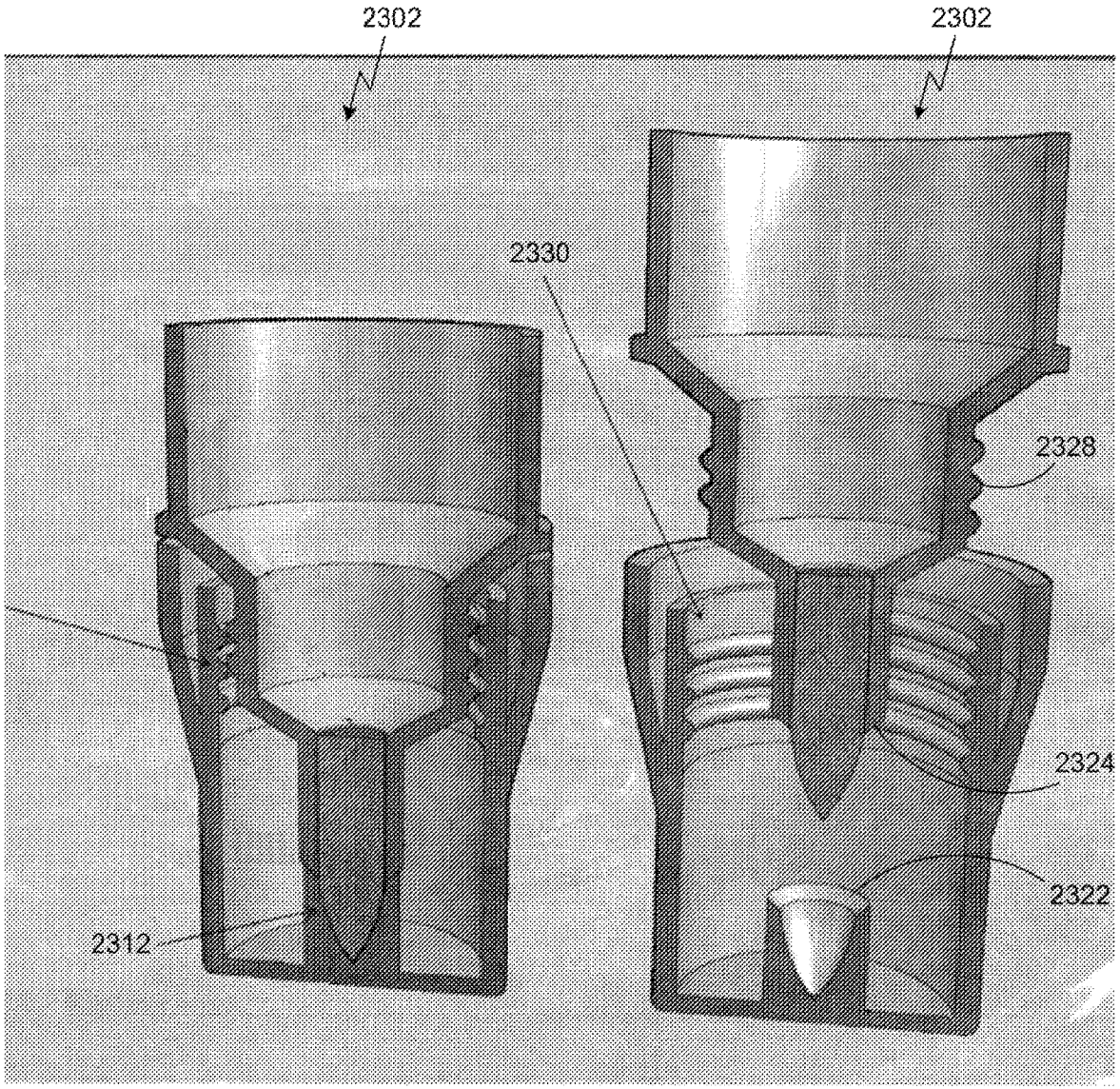
FIG. 26 includes an inverted sectional view of the fluid dispensing apparatus of FIG. 23.
FIG. 27 includes an inverted, partially exploded sectional view of the fluid dispensing apparatus of FIG. 23.

As shown more particularly in FIGS. 26 and 27, in an inverted view of the apparatus 2302 in a closed state, the plug 2312 can store fluid in a form-fitting seal within the tip cavity 2318. In certain embodiments, a beveled portion 2322 of the tip cavity 2318 may correspondingly mate with a beveled portion 2324 of the head 2308 to further resist movement of fluid out of the plug 2312 into other portions of the apparatus 2302.

In other aspects of the invention, a threaded region 2326 of the cap 2316 can be structured for corresponding interaction with a threaded region 2328 of the head 2308, such as to secure the cap 2316 on the head 2308 in closed state of the apparatus 2302. The threaded regions 2326, 2328 can be positioned remotely with respect to the plug 2312 location to resist exposure to fluid by the threaded regions 2326, 2328. It can also be seen that providing a gap distance 2330 or clearance between the threaded regions 2326, 2328 further promotes avoiding fluid retention on the threaded regions 2326, 2328. In certain embodiments, the plug 2312 resists oil from gushing or inadvertently dripping during use or during non-use handling, for example.

Figure 28E:
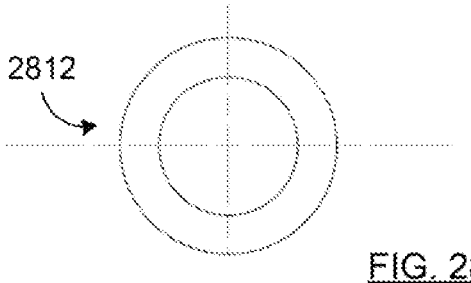
FIGS. 28A-28E illustrate an example of a fluid dispensing apparatus in accordance with various embodiments of the invention.
Figure 28B:
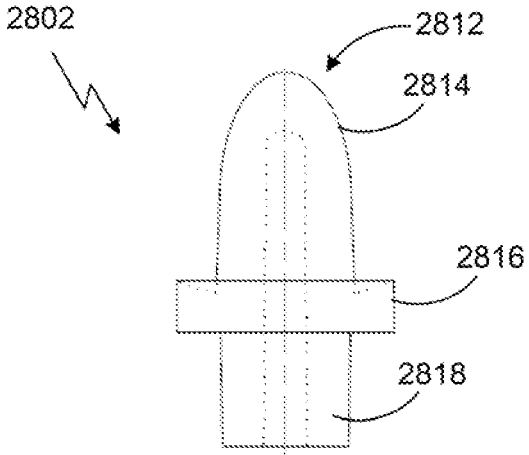
Figure 28D:
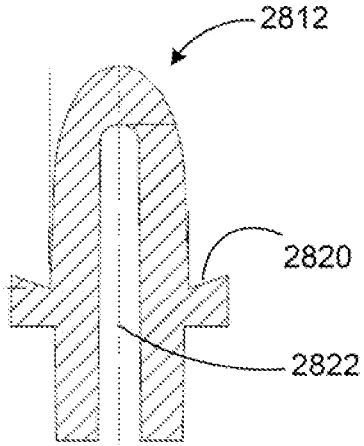
Figure 28A:
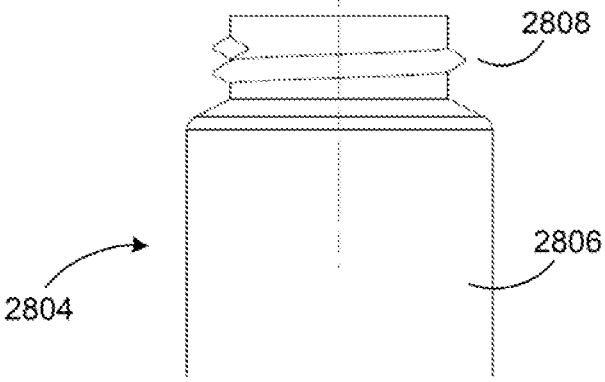
Figure 28C:
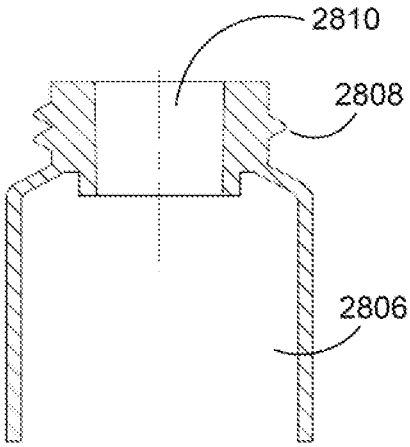

With reference to FIGS. 28A-28E, FIGS. 28A and 28B together illustrate an example of a fluid dispensing apparatus 2802 in accordance with various embodiments of the invention. The apparatus 2802 may include a main body portion 2804 having a fluid repository 2806 and a head 2808. The head 2808 may include an inner cavity 2810 structured to receive a portion of an applicator 2812 therein. The applicator 2812 includes a tip 2814 having an integral collar 2816 formed around the circumference of the tip 2814. A base portion 2818 of the applicator 2812 can be structured to be received into at least a portion of the inner cavity 2810 of the head 2808. In certain embodiments, the collar 2816 may include a slanted portion 2820 around at least a portion of the circumference of the tip 2814. The slanted portion 2820 may form a trough around at least a portion of the tip 2814 and may be structured to catch drips or excess fluid exiting the tip 2814, for example. A channel 2822 may be formed in the applicator 2812 which is structured to communicate fluid from the fluid reservoir 2806 of the apparatus 2802 to a distal end of the applicator 2812, such as during use of the apparatus to dispense fluid onto the face or body of a user, for example. The applicator 2812 may be comprised, at least partially or completely, of a fluid communication material such as materials marketed under the "POREX" trade designation, for example. FIG. 28C illustrates a sectional view of the main body portion 2804 of the apparatus. FIG. 28D illustrates a sectional view of the applicator 2812. FIG. 28E illustrates a top plan view of the applicator 2812.

Figure 29E:
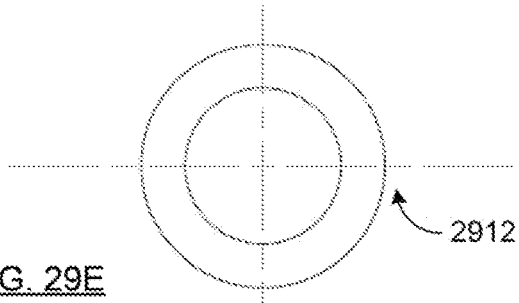
FIGS. 29A-29E illustrate an example of a fluid dispensing apparatus in accordance with various embodiments of the invention.
Figure 29B:
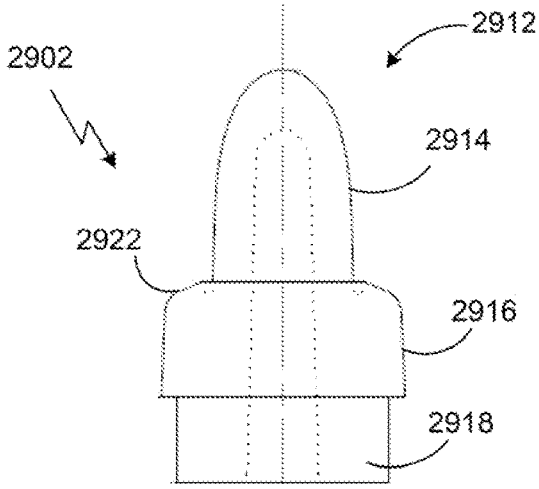
Figure 29D:
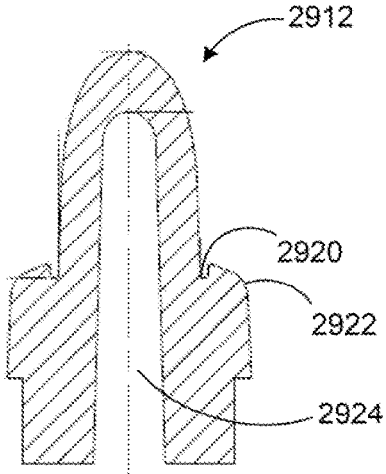
Figure 29A:
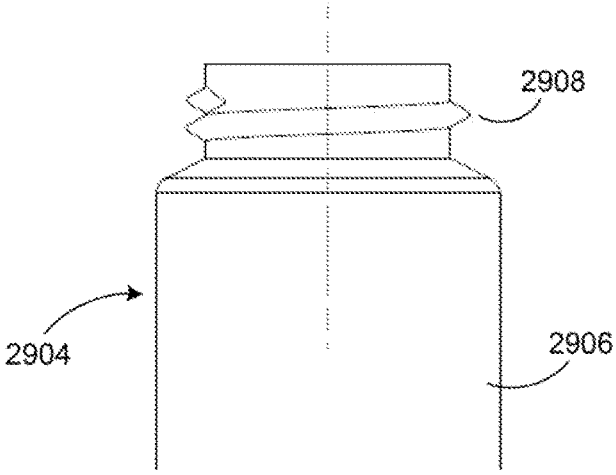
Figure 29C:
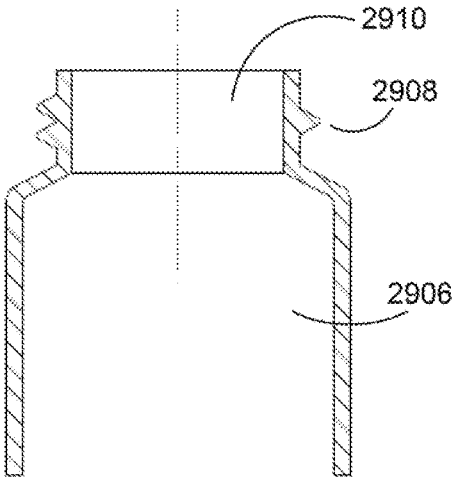

With reference to FIGS. 29A-29E, FIGS. 29A and 29B together illustrate an example of a fluid dispensing apparatus 2902 in accordance with various embodiments of the invention. The apparatus 2902 may include a main body portion 2904 having a fluid repository 2906 and a head 2908. The head 2908 may include an inner cavity 2910 structured to receive an applicator 2912 therein. The applicator 2912 includes a tip 2914 having an integral collar 2916 formed around the circumference of the tip 2914. A base portion 2918 of the applicator 2812 can be structured to be received into at least a portion of the inner cavity 2910 of the head 2908. In certain embodiments, the collar 2916 may include a trough 2920 around at least a portion of the circumference of the tip 2914. The trough 2920 may be structured to catch drips or excess fluid exiting the tip 2914, for example. The collar 2916 may include a radiused portion 2922 which slopes generally downward and away from the tip 2914. A channel 2924 may be formed in the applicator 2912 which is structured to communicate fluid from the fluid reservoir 2906 of the apparatus 2902 to a distal end of the applicator 2912, such as during use of the apparatus to dispense fluid onto the face or body of a user, for example. The applicator 2912 may be comprised, at least partially or completely, of a fluid communication material such as materials marketed under the "POREX" trade designation, for example. FIG. 29C illustrates a sectional view of the main body portion 2904 of the apparatus. FIG. 28D illustrates a sectional view of the applicator 2912. FIG. 28E illustrates a top plan view of the applicator 2912.

FIGS. 30A-30D illustrate an example of an applicator 3002 which can be employed in connection with various embodiments of the invention described herein. As shown, the applicator 3002 may include a tip 3004 having an integral collar 3006 formed around the circumference of the tip 3004. A base portion 3008 of the applicator 3002 can be structured to be received into at least a portion of an inner cavity of a head of a fluid dispensing apparatus (not shown). It can be appreciated that the applicator 3002 may be effectively employed in operative association with many of the embodiments of fluid dispensing apparatuses described herein.

Figure 30D:
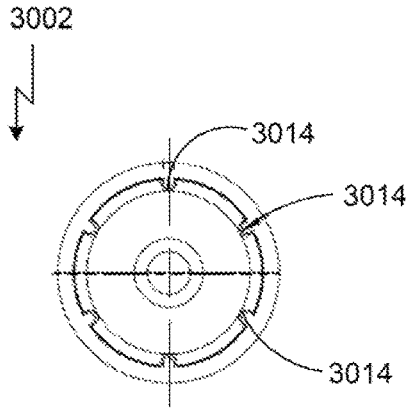
FIGS. 30A-30D illustrate an example of an applicator which can be employed in connection with various fluid dispensing apparatuses described herein.
Figure 30A:
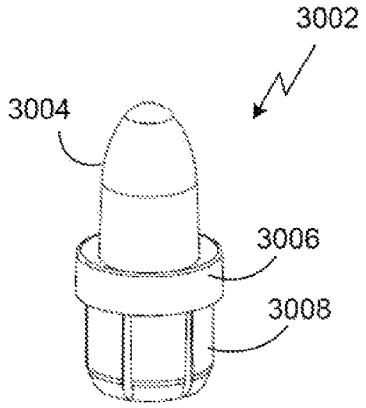
Figure 30C:
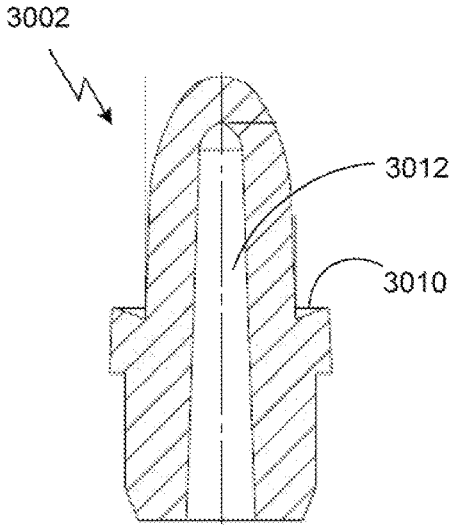
Figure 30B:
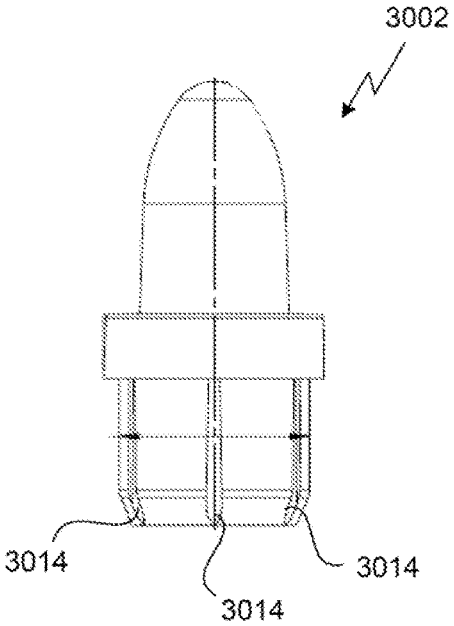

In certain embodiments, the collar 3006 may include a trough 3010 formed around at least a portion of the circumference of the tip 3004. The trough 3010 may be structured to slant downwardly and inwardly toward the tip 3004 to catch drips or excess fluid exiting the tip 3004, for example. A channel 3012 may be formed in the applicator 3002 which is structured to communicate fluid from a fluid reservoir of a dispensing apparatus (not shown) to a distal end of the applicator 3002, such as during use of the apparatus to dispense fluid onto the face or body of a user, for example. In certain embodiments, one or more channels 3014 may be formed in the base portion 3008 of the applicator 3002. One or more of the base portion channels 3014 may have a radiused interior surface (e.g., as shown in FIG. 30D) and may be structured to promote fluid flow from a reservoir of a fluid dispensing apparatus (not shown) to various portions of the applicator 3002. The applicator 3002 may be comprised, at least partially or completely, of a fluid communication material such as materials marketed under the "POREX" trade designation, for example. FIG. 30C illustrates a sectional view of the applicator 3002 as shown in FIG. 30A. FIG. 30D illustrates a sectional view of the applicator 3002 as shown in FIG. 30A.

Figure 31:
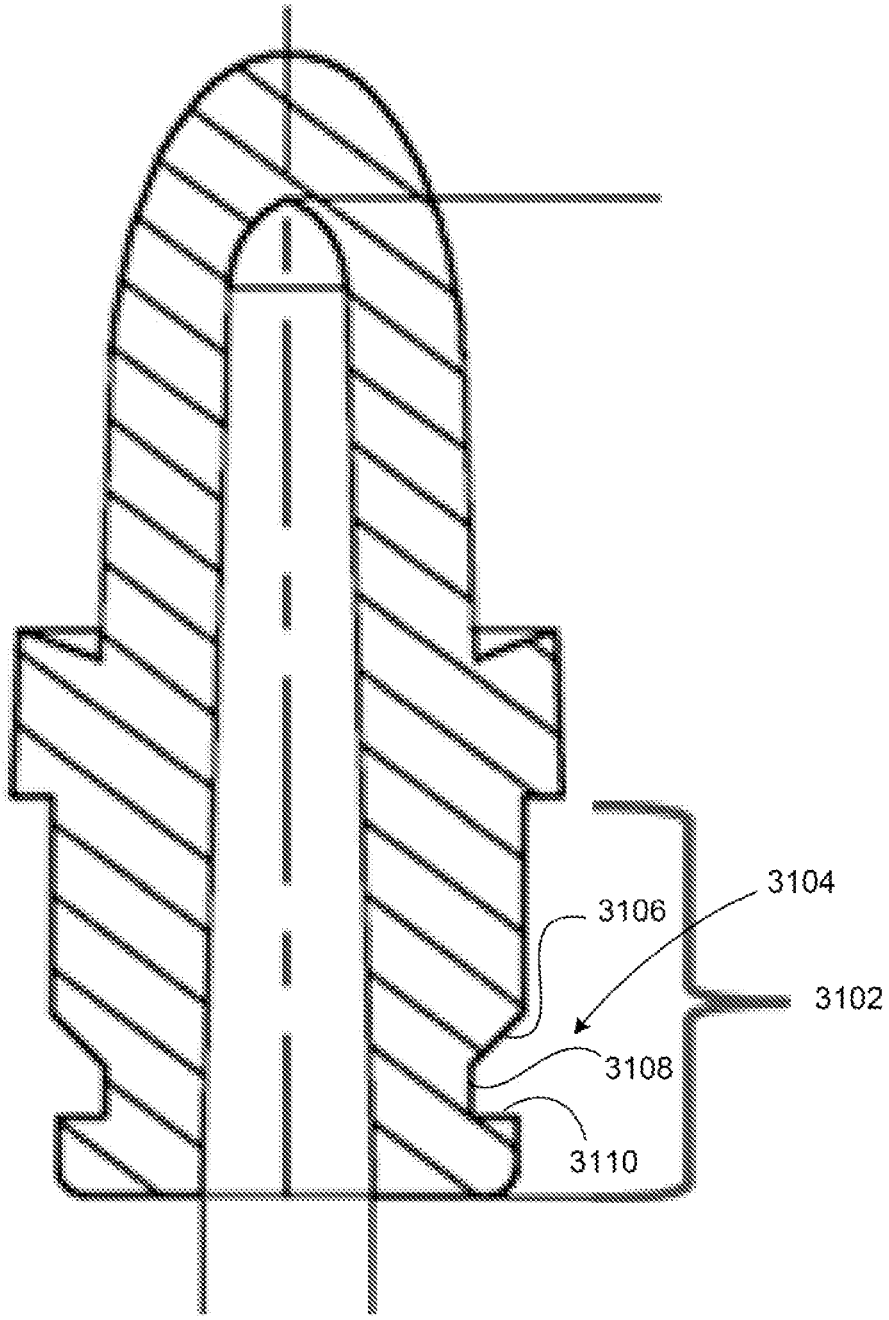
FIG. 31 illustrates an alternative embodiment of the applicator of FIGS. 30A-30D; and, FIGS. 32A-32D illustrate an example of an applicator which can be employed in connection with various embodiments of the invention.

FIG. 31 illustrates an alternative embodiment of the applicator 3002 of FIGS. 30A-30D having a base portion 3102 comprising an indented portion 3104 formed around the circumference of the base portion 3102. As shown, the profile of the indented portion 3104 includes an inwardly angled portion 3106 communicating with generally vertical portion 3108 and generally horizontal portion 3110.

FIGS. 32A-32D illustrate an example of an applicator 3202 which can be employed in connection with various embodiments of the invention described herein. As shown, the applicator 3202 may include a tip 3204 having an integral collar 3206 formed around the circumference of the tip 3204. A base portion 3208 of the applicator 3202 can be structured to be received into at least a portion of an inner cavity of a head of a fluid dispensing apparatus (not shown). It can be appreciated that the applicator 3202 may be effectively employed in operative association with many of the embodiments of fluid dispensing apparatuses described herein.

Figure 32D:
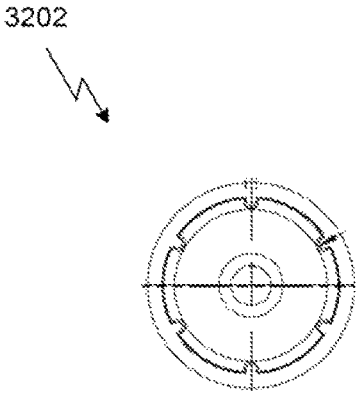
Figure 32A:
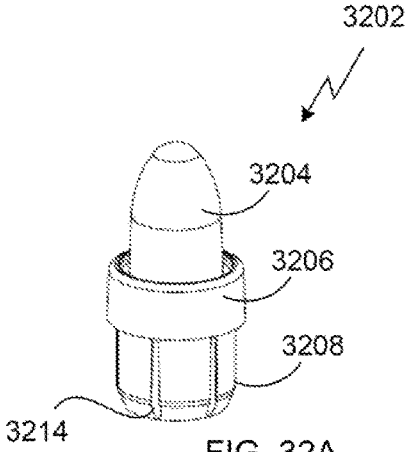
Figure 32C:
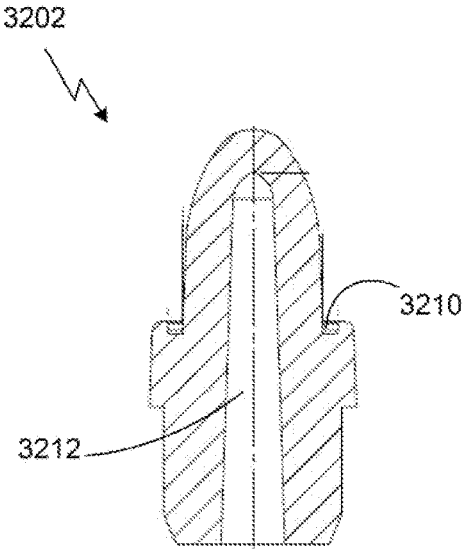
Figure 32B:
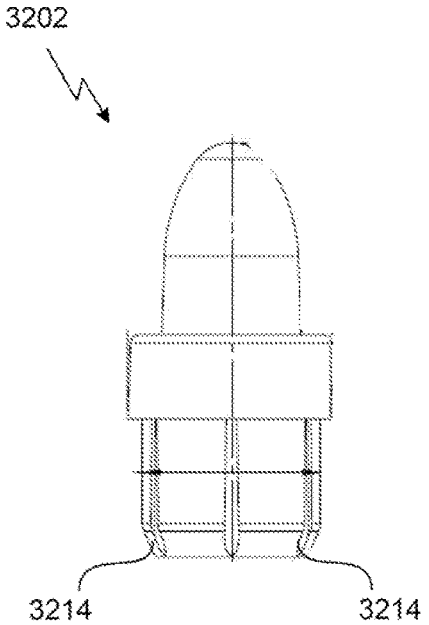

In certain embodiments, the collar 3206 may include a trough 3210 formed around at least a portion of the circumference of the tip 3204. The trough 3010 may be structured in a generally U-shape geometry around the tip 3204 to catch drips or excess fluid exiting the tip 3204, for example. A channel 3212 may be formed in the applicator 3202 which can be structured to communicate fluid from a fluid reservoir of a dispensing apparatus (not shown) to a distal end of the applicator 3202, such as during use of the apparatus to dispense fluid onto the face or body of a user, for example. In certain embodiments, one or more channels 3214 may be formed in the base portion 3208 of the applicator 3202. One or more of the base portion channels 3214 may have a radiused interior surface (e.g., as shown in FIG. 32D) and may be structured to promote fluid flow from a reservoir of a fluid dispensing apparatus (not shown) to various portions of the applicator 3202. The applicator 3202 may be comprised, at least partially or completely, of a fluid communication material such as materials marketed under the "POREX" trade designation, for example. FIG. 32C illustrates a sectional view of the applicator 3202 as shown in FIG. 32A. FIG. 32D illustrates a sectional view of the applicator 3202 as shown in FIG. 32A.

The examples presented herein are intended to illustrate potential and specific implementations of the present invention. It can be appreciated that the examples are intended primarily for purposes of illustration of the invention for those skilled in the art. No particular aspect or aspects of the examples are necessarily intended to limit the scope of the present invention.

Any element expressed herein as a means for performing a specified function is intended to encompass any way of performing that function including, for example, a combination of elements that performs that function. Furthermore the invention, as may be defined by such means-plus-function claims, resides in the fact that the functionalities provided by the various recited means are combined and brought together in a manner as defined by the appended claims. Therefore, any means that can provide such functionalities may be considered equivalents to the means shown herein.

It will be appreciated that, for convenience and clarity of disclosure, terms describing relative orientation or spatial positioning such as "proximal," "distal," "vertical," "horizontal," "up," "down," "top," "front," "back," "bottom," "upward," or "downward" may be used at times herein with respect to the drawings and text description in association with various embodiments of the invention. However, such terms are primarily used for illustrative purposes and are not necessarily intended to be limiting in nature.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein. It should be appreciated that the figures are presented for illustrative purposes and not as construction drawings. Omitted details and modifications or alternative embodiments are within the purview of persons of ordinary skill in the art. For example, there may be variations to these diagrams or the operations described herein without departing from the spirit of the invention.

It can be appreciated that, in certain aspects of the present invention, a single component may be replaced by multiple components, and multiple components may be replaced by a single component, to provide an element or structure or to perform a given function or functions. Except where such substitution would not be operative to practice certain embodiments of the present invention, such substitution is considered within the scope of the present invention.

While various embodiments of the invention have been described herein, it should be apparent, however, that various modifications, alterations and adaptations to those embodiments may occur to persons skilled in the art with the attainment of some or all of the advantages of the present invention. The disclosed embodiments are therefore intended to include all such modifications, alterations and adaptations without departing from the scope and spirit of the present invention as claimed herein.

What is claimed is:

1. A fluid dispensing apparatus comprising:

a fluid reservoir in fluid communication with a head;

a tip positioned at least partially within the head, the tip having a main body portion and an integrally formed collar positioned around the outside of the main body portion;

a channel formed within the tip, the channel being structured for communicating fluid from the fluid reservoir to a distal end of the tip; and wherein the tip comprises first and second pore regions, wherein the first pore region is positioned at one end of the channel and comprises pores of a size which are larger than a pore size of pores included in the second pore region which is located at an opposite end of the channel.

2. The apparatus of claim 1, wherein the collar further comprises a trough formed therein.

3. The apparatus of claim 2, wherein the trough is structured to slant angularly downward from an outside circumference of the trough toward a central portion of the tip.

4. The apparatus of claim 1, wherein the collar is structured with a radiused profile which slopes generally downwardly away from the main body portion of the tip.

5. The apparatus of claim 1, wherein the tip comprises a fluid communication material suitable for retaining an oil-based fluid therein.

6. The apparatus of claim 1, wherein the tip further comprises a foam material.

7. The apparatus of claim 6, wherein the foam material comprises an open cell foam material.

8. The apparatus of claim 1, wherein the tip further comprises a polymer substance.

9. The apparatus of claim 1, further comprising a cap including a tip cavity structured to receive and correspondingly align with the tip.

10. The apparatus of claim 1, further comprising a sleeve positioned on the head.

11. The apparatus of claim 10, further comprising a cap having a cap reservoir positioned therein which is structured to correspondingly align with the sleeve.

12. The apparatus of claim 11, wherein the sleeve and the cap reservoir each comprise a fluid communication material suitable for retaining an oil-based fluid therein.

13. The apparatus of claim 12, wherein the sleeve is comprised of a material having a porosity which is lower than a porosity of which the cap reservoir is comprised.

14. The apparatus of claim 1, wherein the tip comprises a generally bullet shape.

15. The apparatus of claim 1, wherein the tip comprises a radiused portion at the distal end of the tip.

* * * * *